US010283298B2

(12) United States Patent
Ogawa et al.

(10) Patent No.: US 10,283,298 B2
(45) Date of Patent: May 7, 2019

(54) CHIP FUSE

(71) Applicant: SOC Corporation, Tokyo (JP)

(72) Inventors: Toshitaka Ogawa, Tochigi (JP); Hiroo Arikawa, Tokyo (JP)

(73) Assignee: SOC Corporation, Tokyo (JP)

( * ) Notice: Subject to any disclaimer, the term of this patent is extended or adjusted under 35 U.S.C. 154(b) by 0 days.

(21) Appl. No.: 15/593,331

(22) Filed: May 12, 2017

(65) Prior Publication Data

US 2017/0250046 A1 Aug. 31, 2017

Related U.S. Application Data

(63) Continuation of application No. PCT/JP2014/080101, filed on Nov. 13, 2014.

(51) Int. Cl.
*H01H 85/143* (2006.01)
*H01H 69/02* (2006.01)
(Continued)

(52) U.S. Cl.
CPC ..... *H01H 69/022* (2013.01); *H01H 69/02* (2013.01); *H01H 85/046* (2013.01);
(Continued)

(58) Field of Classification Search
CPC ..... H01H 69/022; H01H 85/0411; H01H 85/046; H01H 85/08; H01H 85/143; H01H 2085/0414; H01H 69/02; H01H 85/06
(Continued)

(56) References Cited

U.S. PATENT DOCUMENTS 5,479,147 A * 12/1995 Montgomery ..... H01H 85/0411 337/273
5,805,048 A * 9/1998 Saitoh ..... H01H 69/02 337/268
(Continued)

FOREIGN PATENT DOCUMENTS

CN 1692463 11/2005
JP H08235999 9/1996
(Continued)

OTHER PUBLICATIONS

"International Preliminary Report on Patentability; this report contains the following items :Form PCT/IB/326,PCT/IB/373, PCT/ISA237(cover sheet), PCT/ISA237(Box No. I), PCT/ISA237(Box No. V)", dated May 26, 2017, with English translation of "Written Opinion of the International Searching Authority", and "International Search Report (Form PCT/ISA/210) ", dated Feb. 17, 2015, with English translation thereof, pp. 1-13.
(Continued)

*Primary Examiner* — Jacob R Crum
(74) *Attorney, Agent, or Firm* — JCIPRNET

(57) ABSTRACT

A method for manufacturing a chip fuse, comprises: a liquid film forming step for forming a liquid film of dispersion liquid having metal nanoparticles dispersed therein on a principal surface of a substrate; a fuse film forming step for forming a fuse film on the principal surface by irradiating the liquid film with laser light; and a first terminal forming step for forming first terminals that each connects to the fuse film on each of both end sides in a longitudinal direction of the fuse film on the principal surface.

10 Claims, 23 Drawing Sheets

(51) Int. Cl.
*H01H 85/06* (2006.01)
*H01H 85/08* (2006.01)
*H01H 85/041* (2006.01)
*H01H 85/046* (2006.01)

(52) U.S. Cl.
CPC ..... *H01H 85/0411* (2013.01); *H01H 85/06* (2013.01); *H01H 85/08* (2013.01); *H01H 85/143* (2013.01)

(58) Field of Classification Search
USPC ..... 337/159, 290, 295, 413, 416
See application file for complete search history.

(56) References Cited

U.S. PATENT DOCUMENTS 5,929,741 A * 7/1999 Nishimura ..... H01H 85/0411 337/159
6,150,916 A * 11/2000 Lin ..... H01L 23/5258 257/209
7,521,802 B2 4/2009 Takewaki et al.
7,888,254 B2 2/2011 Takewaki et al.
2004/0169578 A1* 9/2004 Jollenbeck ..... H01H 85/046 337/227
2004/0184211 A1* 9/2004 Bender ..... H01H 69/022 361/104
2005/0040926 A1 2/2005 Ely et al.
2005/0062577 A1* 3/2005 Rupalla ..... H01H 85/046 337/159
2005/0230782 A1* 10/2005 Takewaki ..... H01L 23/5256 257/529
2008/0191832 A1* 8/2008 Tsai ..... H01H 69/022 337/297
2009/0102594 A1 4/2009 Ogilvie
2009/0167480 A1 7/2009 Wiryana et al.
2009/0176364 A1 7/2009 Takewaki et al.
2012/0115324 A1 5/2012 Takewaki et al.
2016/0322301 A1* 11/2016 Minami ..... H01L 29/0649

FOREIGN PATENT DOCUMENTS

JP 2005505110 2/2005
JP 2005268454 9/2005
JP 2006-339105 12/2006
JP 2007-095592 4/2007
JP 2007-165086 6/2007
JP 2009509308 3/2009

OTHER PUBLICATIONS

"Search Report of European Counterpart Application", dated Feb. 28, 2018, pp. 1-6.
"Office Action of China Counterpart Application," dated Jul. 3, 2018, with English translation thereof, p. 1-p. 10.
Tang Zhengning et al., "Specialty Printing Technique", Graphic Communications Press, Sep. 2007, with partial English translation, pp. 1-6.
"Office Action of China Counterpart Application," dated Jan. 30, 2019,with English translation thereof, pp. 1-10.

* cited by examiner

| Conduction cross-sectional area $A_0$ ($\mu m^2$) | Fuse element film thickness t (μm) | Fuse element width w (μm) | t/w ratio | Specific surface area $\xi_1$ ($\mu m^{-1}$) | Specific surface area $\xi_2$ ($\mu m^{-1}$) | Specific surface area $\xi_3$ ($\mu m^{-1}$) |
|---|---|---|---|---|---|---|
| 1 | 0.01 | 100 | 0.0001 | 200.02 | 100 | 100.02 |
| 1 | 0.1 | 10 | 0.01 | 20.2 | | 10.2 |
| 1 | 1 | 1 | 1 | 2 | 1 | 3 |
| 1 | 10 | 0.1 | 100 | 20.2 | 0.1 | 20.1 |
| 1 | 100 | 0.01 | 10000 | 200.02 | 0.01 | 200.01 |

FIG. 15

| | Fuse element film thickness t (μm) | Fuse element width w (μm) | Conduction cross-sectional area $A_0$ ($\mu m^2$) | t/w ratio | Minimum melting current density $(I/A_0)_{min}$($A/cm^2$) |
|---|---|---|---|---|---|
| Test sample (1) | 0.61 | 10.4 | 6.34 | 0.059 | 1.32E+06 |
| Test sample (2) | 0.25 | 25.5 | 6.38 | 0.0098 | 1.96E+06 |
| Test sample (3) | 0.15 | 41.6 | 6.27 | 0.0035 | 2.67E+06 |

FIG. 16

CHIP FUSE

CROSS-REFERENCE TO RELATED APPLICATIONS

The present application is a continuation application of International Application number PCT/JP2014/080101, filed on Nov. 13, 2014. The content of this application is incorporated herein by reference in its entirety.

BACKGROUND OF THE INVENTION

The present invention relates to a method for manufacturing a chip fuse and to a chip fuse.

Fuses are used in order to prevent occurrence of circuit breakdown due to an inflow of excess current caused by a failure, or the like, in an electronic device. Recently, with the miniaturization of devices, chip fuses have been employed that are easily surface-mounted on wiring boards, etc., and that excel in high-volume production. In a chip fuse, a fuse element made of a metal foil is formed on an insulating substrate, such as a ceramic substrate, etc., (hereinafter, also simply referred to as a substrate).

It has been requested, in chip fuses, to reduce a melting current that melts the fuse element (to, for example, 100 mA or less); namely, to reduce the capacity. Various proposals have been made in order to respond to such request.

For example, Japanese Unexamined Patent Application Publication No. 2005-505110 discloses a fuse in which a tin core is surrounded by a silver casing. In addition, Japanese Unexamined Patent Application Publication No. 2009-509308 discloses a fuse in which tin is coated over a copper fuse link. With the technology of Japanese Unexamined Patent Application Publication No. 2005-505110 and Japanese Unexamined Patent Application Publication No. 2009-509308, when the fuse element melts, tin with a low melting point melts first, becomes diffused in silver or copper, and lowers a melting point of the fuse element, and thus, the melting current of the fuse may be reduced.

Moreover, Japanese Unexamined Patent Application Publication No. 2007-095592 discloses the technology by which a fuse part is formed on a silicone substrate and a hollow part is formed directly under the fuse part of the substrate by means of etching. Since heat loss to the substrate can be reduced by forming the hollow part, a reduction in the melting current of the fuse may be expected.

However, with the technology of Japanese Unexamined Patent Application Publication No. 2005-505110 and Japanese Unexamined Patent Application Publication No. 2009-509308, the manufacturing cost increases due to the multi-layered structures. Moreover, there is a risk that tin may be diffused unnecessarily in silver or copper. Furthermore, with the technology of Patent Document 3, there is a risk that the chip fuse cost increases since significant man-hours are needed for the process of etching the substrate.

In addition, a rush current (also referred to as an inrush current) is known to occur at the time of switching on and/or off the power supply to the circuit. Accordingly, as to the chip fuse, it is required that it melts when an abnormal current flows therethrough but that it tolerates and does not melt when the rush current occurs at the time of switching on and/or off the power supply (in other words, it is required that it has a high rush resistance).

BRIEF SUMMARY OF THE INVENTION

Accordingly, the present invention has been made in view of these points and an object thereof is to provide a reduced capacity and high rush resistant chip fuse at a low price.

In one aspect of the present invention, a method for manufacturing a chip fuse is provided, which comprises: a liquid film forming step for forming a liquid film of dispersion liquid having metal nanoparticles dispersed therein on a principal surface of a substrate; a fuse film forming step for forming a fuse film on the principal surface by irradiating the liquid film with laser light; and a first terminal forming step for forming first terminals that each connects to the fuse film on each of both end sides in a longitudinal direction of the fuse film on the principal surface.

BRIEF DESCRIPTION OF THE DRAWINGS

FIG. 15 is a table summarizing the correlations among the width w, the thickness t and the specific surface areas $\xi_1$ to $\xi_3$ of the fuse element 920.

FIG. 16 is a table summarizing the relationship between the t/w ratio and the minimum melting current density $(I/A_0)_{min}$.

DETAILED DESCRIPTION OF THE INVENTION

Figure 1:
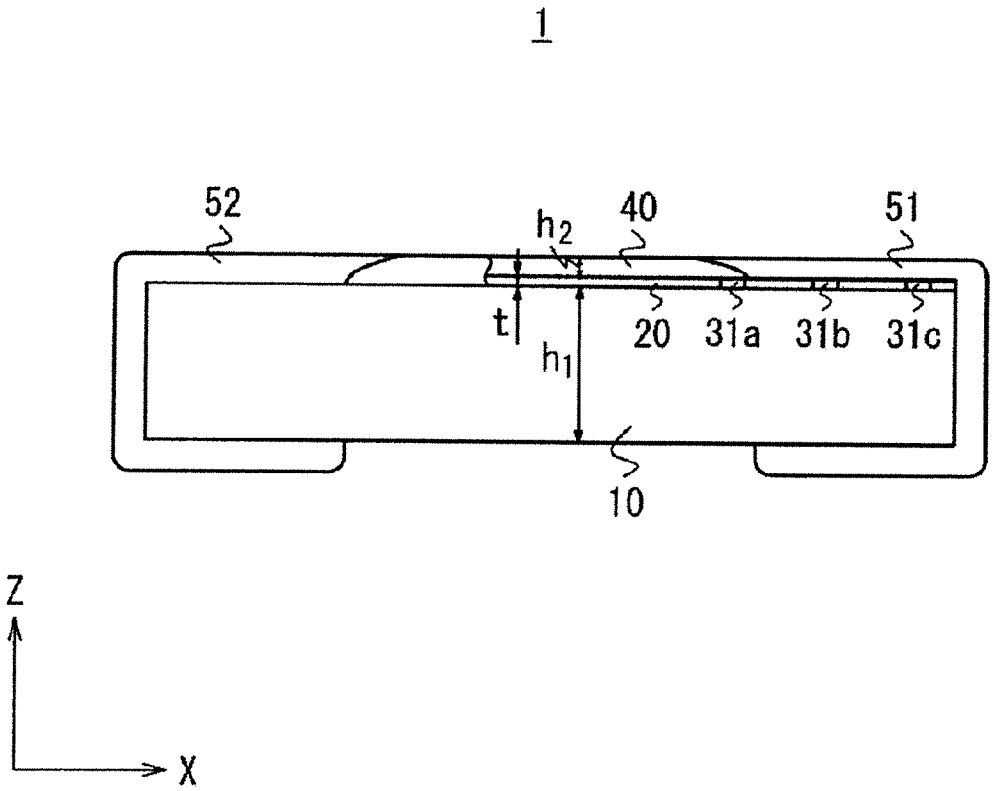
FIG. 1 is a schematic cross-sectional diagram of a chip fuse 1 according to an embodiment of the present invention.

In the following, the description will be given in the order indicated below.

1. Configuration of chip fuse
2. Theoretical analysis of chip fuse pre-arcing time-current characteristics
3. Studies leading up to the invention of the present application
3-1. First study
3-2. Second study
3-3. Third study
3-4. Fourth study
4. Method for manufacturing chip fuse
5. Study regarding the firing of ink film
6. Variation <1. Configuration of Chip Fuse>

Figure 2:
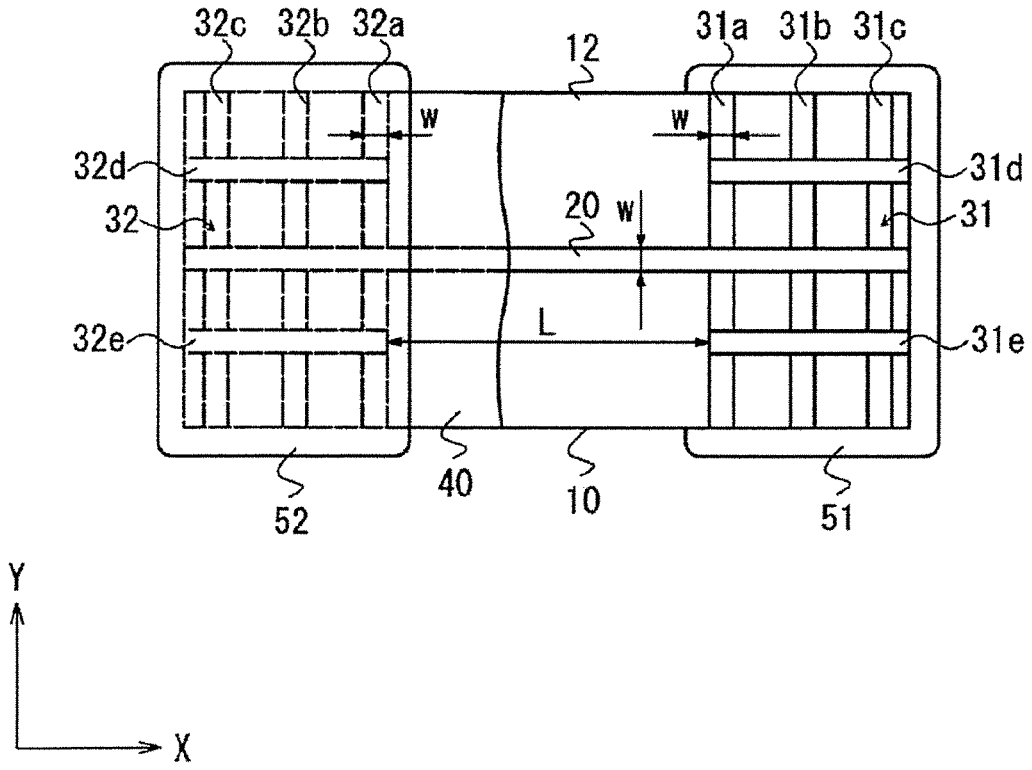
FIG. 2 is a schematic plan view of a chip fuse 1.

The configuration of a chip fuse 1 according to an embodiment of the present invention will now be described with reference to FIGS. 1 and 2. FIG. 1 is a schematic cross-sectional diagram of a chip fuse 1 according to an embodiment. FIG. 2 is a schematic plan view of the chip fuse 1.

The chip fuse 1 is surface-mounted on a circuit substrate, etc. of an electronic device and melts when an abnormal current flows in the circuit. As shown in FIGS. 1 and 2, the chip fuse 1 includes a support substrate 10, a fuse film 20, internal terminal groups 31, 32, an overcoat 40 and external terminals 51, 52.

The support substrate 10 is a substrate for supporting the fuse film 20 and the internal terminal groups 31, 32. The support substrate 10 is, for example, a polyimide substrate. The thickness of the support substrate 10 is approximately 250 (μm) and the surface roughness Ra thereof is approximately 0.05). Additionally, the thermal conductivity of the support substrate 10 is 0.3 (W/m·K) or less.

The fuse film 20 is provided on the principal surface 12 of the support substrate 10. Although the details thereof are described hereinafter, the fuse film 20 is formed on the principal surface 12 by firing an ink film containing metal nanoparticles. As the metal nanoparticles, for example, silver nanoparticles are used.

In the present embodiment, the melting current density, which is obtained by dividing the minimum melting current that melts the fuse film 20 by the cross-sectional area that is orthogonal to the longitudinal direction of the fuse film 20, is $4.0\times10^6$ (A/cm$^2$) or less. Desirably, it is preferable for the melting current density to be $3.5\times10^6$ (A/cm$^2$) or less.

The specific surface area, which is obtained by dividing the surface area of the fuse film 20 by the volume of the fuse film 20, is 21 (/μm) or less. For this purpose, it is desirable for the width w of the fuse film 20 to be 3-20 (μm) and for the thickness t thereof to be 0.1-3.0 (μm). Moreover, it is more desirable for the width w and the thickness t to have values that hold the relationship of $0.01<t/w\leq1$. Furthermore, the length (the length L shown in FIG. 2) of the fuse film 20 between an internal terminal 31*a* of the internal terminal group 31 and an internal terminal 32*a* of the internal terminal group 32 is 600 (μm) or more. It should be noted that the above-described setting of the numerical ranges is for realization of a chip fuse with a reduced capacity and an improvement in the rush resistance, and the details thereof will be described hereinafter.

As shown in FIG. 2, the internal terminal group 31 is provided to connect to the fuse film 20 on the one end side in the longitudinal direction of the fuse film 20 on the principal surface 12 of the support substrate 10. The internal terminal group 32 is provided to connect to the fuse film 20 on the other end side in the longitudinal direction of the fuse film 20. The internal terminal group 31 includes a plurality of internal terminals (three internal terminals 31*a*, 31*b* and 31*c* in FIG. 2) which are separated from each other in the longitudinal direction. The internal terminal group 31 also includes internal terminals 31*d*, 31*e* which connect the three internal terminals 31*a*, 31*b* and 31*c*. The internal terminal group 32 similarly includes a plurality of internal terminals (internal terminals 32*a*, 32*b*, 32*c*, 32*d* and 32*e*). Since the configurations of the internal terminal group 31 and the internal terminal group 32 are the same, the detailed configuration will be described herein by taking the internal terminal group 31 as an example.

Each of the internal terminals 31*a*-31*c* of the internal terminal group 31 is provided along the intersecting direction (in particular, the Y-direction orthogonal to the X-direction which is the longitudinal direction as shown in FIG. 2) that intersects with the longitudinal direction of the fuse film 20.

As shown in FIG. 2, each of the internal terminals 31*a*-31*c* has the same width w. The width of the internal terminals 31*a*-31*c* is the same as the width w of the fuse film 20. In addition, as shown in FIG. 1, the thickness t of each of the internal terminals 31*a*-31*c* is the same as the thickness t of the fuse film 20. As can be seen from the above, with the present embodiment, the cross-sectional area of the internal terminals 31*a*-31*c* is small in a similar manner to that of the linear fuse film 20. The internal terminals 31*d*, 31*e* are provided on both sides of the fuse film 20 along the longitudinal direction of the fuse film 20. The width w and the thickness t of the internal terminals 31*d*, 31*e* are the same as the width w and the thickness t of the internal terminals 31*a*-31*c*. It should be noted that it has been described that the internal terminal groups 31, 32 include the internal terminals 31*d*, 31*e* and 32*d*, 32*e* that respectively connect the internal terminals 31*a*-31*c* and the internal terminal 32*a*-32*c*; however, the present invention is not limited thereto and it is possible that the internal terminals 31, 32 may not include internal terminals 31*d*, 31*e*, 32*d* and 32*e*.

The overcoat 40 is a covering part that covers the central portion in the longitudinal direction of the fuse film 20. The overcoat 40 also covers the internal terminal 31*a*, which is located closest to the central portion in the longitudinal direction among the internal terminal group 31, and the internal terminal 32*a*, which is located closest to the central portion in the longitudinal direction among the internal terminal group 32.

The thermal conductivity of the overcoat 40 is 0.3 (W/m·K) or less. By way of this, the heat loss to the overcoat 40 can be suppressed. It should be noted that the thermal conductivity of the overcoat 40 is preferably the same as the thermal conductivity of the support substrate 10. In this way, the heat loss can be effectively suppressed.

The external terminal 51 is electrically connected to one or a plurality of the internal terminals (to the internal terminal 31*b* and the internal terminal 31*c* in FIG. 2) of the internal terminal group 31 on one end side in the longitudinal direction of the fuse film 20. The external terminal 52 is connected to one or a plurality of the internal terminals (to the internal terminal 32*b* and the internal terminal 32*c* in FIG. 2) of the internal terminal group 32 on the other end side in the longitudinal direction.

In this manner, each of the external terminal 51 and the external terminal 52 is connected to some internal terminals (to the internal terminals that are on both end sides in the longitudinal direction) that configure the internal terminal groups 31, 32. By way of this, the heat loss to the external terminals 51, 52 via the internal terminals can be suppressed.

As described above, in the chip fuse 1 according to the present embodiment, the thickness of the internal terminal groups 31, 32 is reduced such that it is the same with the thickness of the fuse film 20 and the internal terminal groups 31, 32 are configured by the plurality of separated-apart internal terminals. By way of this, the heat capacity of the internal terminals connected to the fuse film 20 can be reduced, and thus, the heat loss can also be reduced. Moreover, the external terminals 51, 52 with a relatively large heat capacity are connected only to some of the terminals of the internal terminal groups 31, 32 and thus, the heat loss from the fuse film 20 to the external terminals 51, 52 can be reduced, and consequently, this is effective for reducing the capacity of the chip fuse 1.

Figure 3:
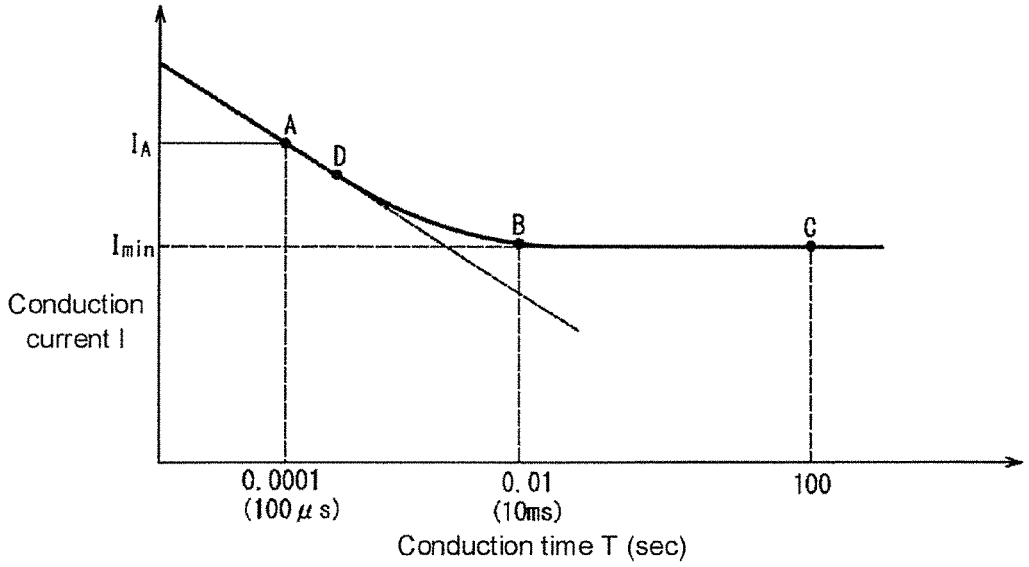
FIG. 3 is a graph showing a pre-arcing time-current characteristic curve of a chip fuse 1.

FIG. 3 is a graph showing the pre-arcing time-current characteristic curve of the chip fuse 1. As can be seen from the graph, the pre-arcing time-current characteristic curve assumes a pseudo straight line with a predetermined slope in the region where the conduction time T is small, such as at point A (T=100 (μs)). On the other hand, as the conduction time T increases, the pre-arcing time-current characteristic curve deviates from the pseudo straight line and assumes a substantially horizontal straight line.

During the interval from point B (T=10 (ms)) to point C (T=100 (s)), the pre-arcing time-current characteristic curve assumes a substantially horizontal straight line and the conduction current at point C has a minimum value $I_{min}$ within such interval. It should be noted that it was confirmed that $I_{min}$ here is 85 (mA) and the minimum melting current is 100 (mA) or less.

<2. Theoretical Analysis of Chip Fuse Pre-Arcing Time-Current Characteristics>

In the following, mathematical expressions will be used to provide the theoretical analysis, and the features of the pre-arcing time-current characteristics of a commonly used chip fuse will be described.

Figure 4:
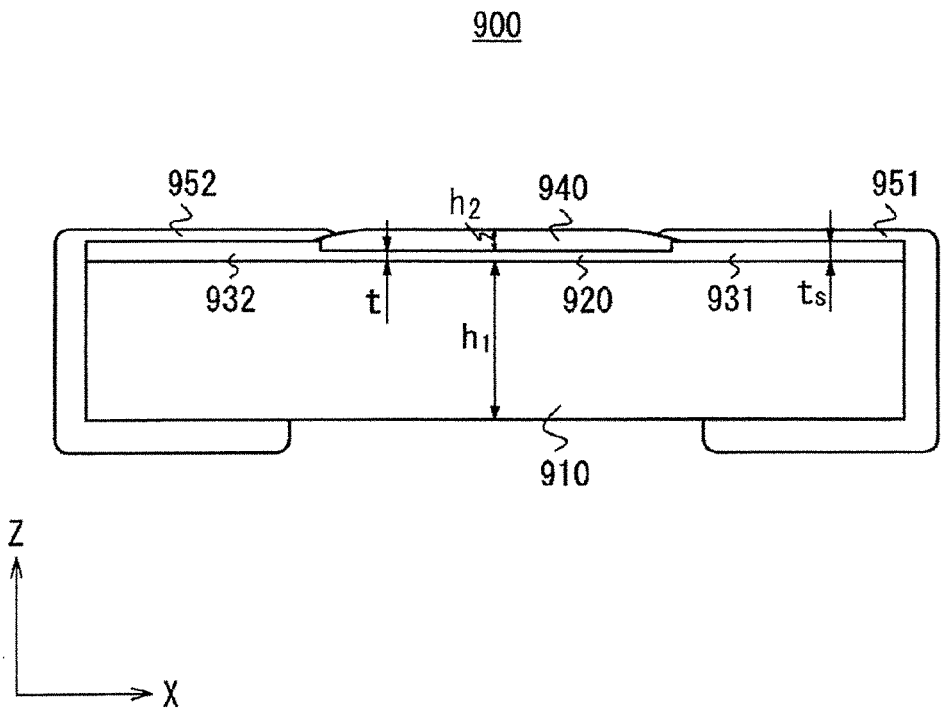
FIG. 4 is a schematic cross-sectional diagram of a chip fuse 900, which is a target of the analysis.
Figure 5:
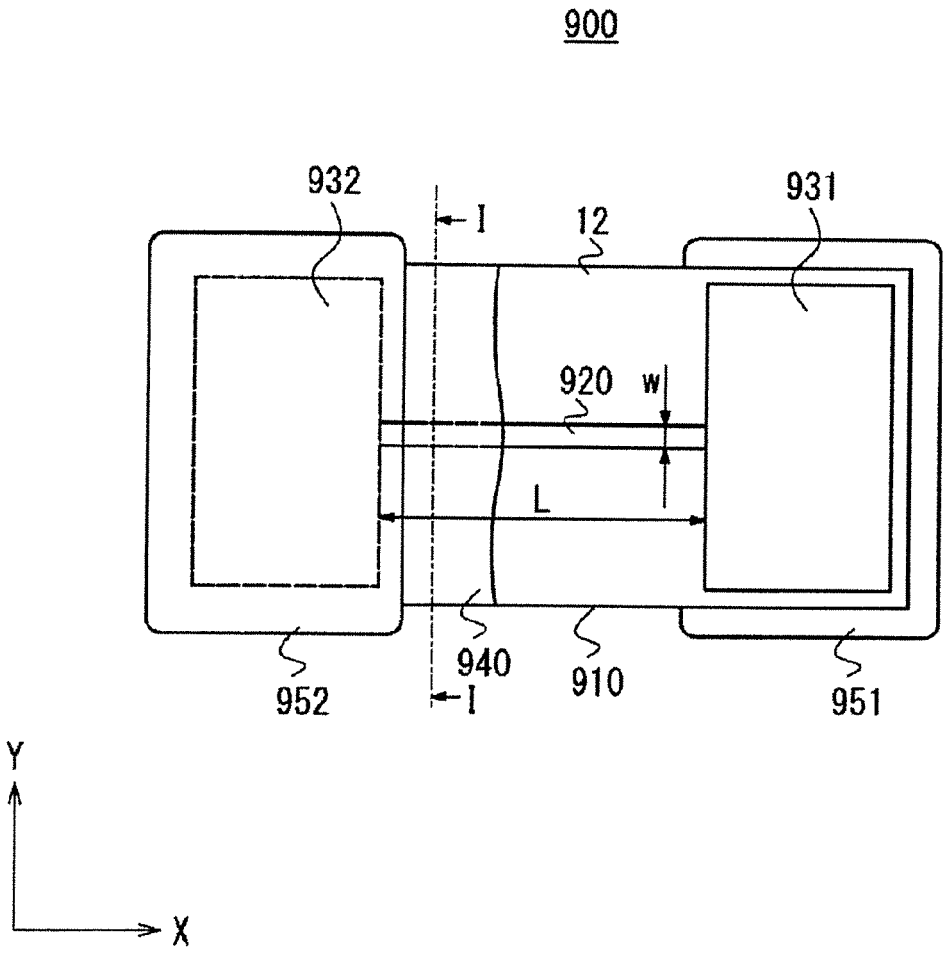
FIG. 5 is a schematic plan view of a chip fuse 900, which is a target of the analysis.
Figure 6:
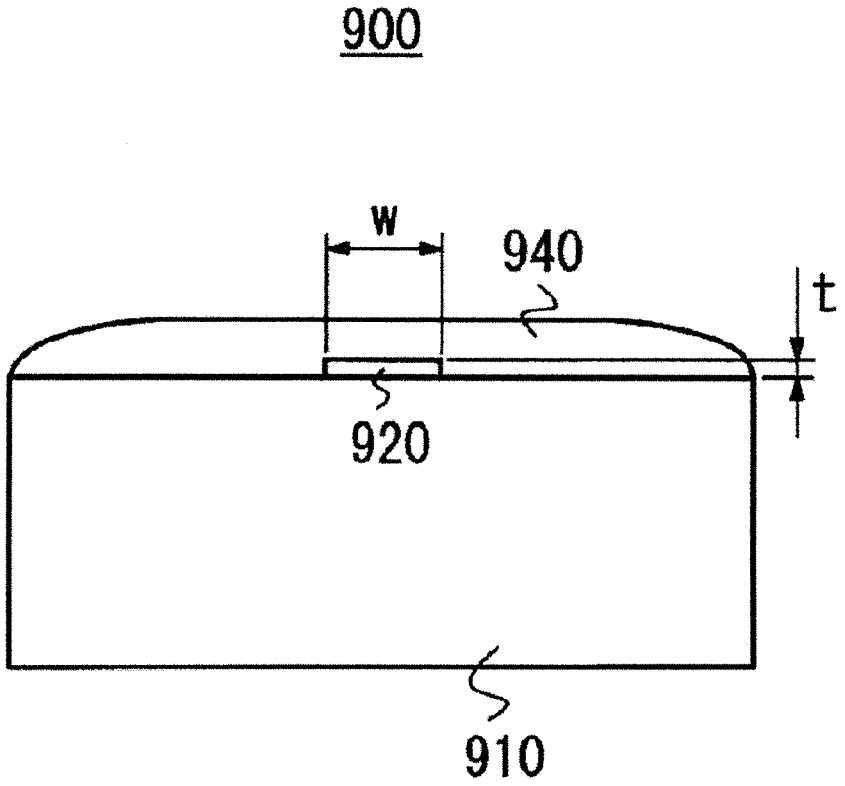
FIG. 6 is a cross-sectional diagram through I-I in FIG. 5.

Prior to the theoretical analysis, the configuration of a chip fuse 900, which is the target of the analysis, will now be described with reference to FIGS. 4 to 6. FIG. 4 is a schematic cross-sectional diagram of the chip fuse 900, which is the target of the analysis. FIG. 5 is a schematic plan view of the chip fuse 900, which is the target of the analysis. FIG. 6 is a cross-sectional diagram through I-I in FIG. 5.

As shown in FIGS. 4 to 6, the chip fuse 900 includes a support substrate 910, a fuse film 920, internal terminals 931, 932, an overcoat 940 and external terminals 951, 952. The configuration of the internal terminals 931, 932 of the chip fuse 900 is significantly different with respect to the chip fuse 1 shown in FIG. 1. Namely, the internal terminals 931, 932 are formed in a flat plate over a wide area as shown in FIG. 5, and the width of the internal terminals 931, 932 is larger than the width w of the fuse film. In addition, as shown in FIG. 4, the thickness $t_s$ of the internal terminals 931, 932 is larger than the thickness t of the fuse film 920.

In the chip fuse 900, the heat generated by the fuse film 920 through the conduction is transferred to: the support substrate 910 that is in close contact with and supports the fuse film 920; the overcoat 940 that is in close contact with the fuse film 920; and the like. Accordingly, since heat loss occurs in the chip fuse 900, it is important to determine the characteristics of the fuse film 920 in light of the heat loss.

After exerting a variety of originality and ingenuity, the inventors have come to derive the following mathematical expression (1), which is an energy equilibrium equation relating to a model in which the fuse film 920 (hereinafter referred to as the fuse element 920) of the chip fuse 900 generates heat by conduction, by applying a fundamental equation relating to thermal dynamics to a commonly-used chip fuse.

$$C_v \cdot V \cdot \Delta\theta_e = R \cdot I^2 \cdot T - \lambda_1 \cdot A_0 (2\Delta\theta_1/L) T - \lambda_2 \cdot A_{S1} \cdot \Delta\theta_2/h_1 \cdot T - \lambda_3 \cdot A_{S2} \cdot \Delta\theta_3/h_2 \cdot T - \sigma \cdot \varepsilon \cdot F \cdot A_S \{(\theta_4)^4 - (\theta_5)^4\} T \quad (1)$$

It should be noted that the respective symbols (factors) in expression (1) have the following meanings:

$C_v$: constant volume heat capacity of fuse element [J/(Km$^3$)];

V: fuse element volume [m$^3$];

L: fuse element length [m];

$A_0$: conducting cross-sectional area of fuse element [m$^2$];

R: fuse element resistance [Ω];

$A_s$: fuse element surface area [m$^2$];

$A_{s1}$: contact area between fuse element and support substrate [m$^2$], $A_{s2}$: contact area of fuse element with overcoat [m$^2$];

$h_1$: fuse element support substrate thickness [m];

$h_2$: overcoat representative thickness [m];

I: conduction current [A];

T: conduction time [sec];

$\lambda_1$: fuse element thermal conductivity [W/(mK)];

ε: fuse element emissivity [-];

F: configuration factor relating to thermal emission [-];

$\lambda_2$: fuse element support substrate thermal conductivity [W/(mK)];

$\lambda_3$: overcoat thermal conductivity [W/(mK)];

σ: Stefan-Boltzmann constant [W/(m$^2$K$^4$)];

$\theta_4$: fuse element representative temperature [K];

$\theta_5$: support substrate representative temperature [K];

$\Delta\theta_e$: fuse element temperature elevation value due to conduction [K];

$\Delta\theta_1$: temperature difference between fuse element and terminal part [K];

$\Delta\theta_2$: temperature difference between both surfaces of fuse element support substrate [K];

$\Delta\theta_3$: temperature difference between both surfaces of overcoat [K]; and $\Delta\theta_m$: temperature elevation value of fuse element to melting point due to conduction [K].

The left side of expression (1) indicates the amount of heat required to raise the temperature of the fuse element 920 with constant volume heat capacity $C_V$ and volume V by $\Delta\theta_e$. The first term on the right side of expression (1) indicates the Joule heat generation when current I is conducted through the fuse element 940 with resistance R only for time period T. The second term on the right side indicates the heat loss due to heat transfer from the fuse element 920 to the external terminals 951, 952 via the internal terminals 931, 932. The third term on the right side indicates the heat loss due to heat transfer from the fuse element 920 to the support substrate 910. It should be noted that the temperatures of the fuse element 920 and the support substrate 910 are assumed to be the same at their joint interface and the heat loss due to convection from the back surface of the support substrate 910 is ignored. The fourth term on the right side indicates the heat loss due to heat transfer from the fuse element 920 to the overcoat 940. It should also be noted that the temperatures of the fuse element 920 and the overcoat 940 are assumed to be the same at their joint interface and the heat loss due to convection from the surface of the overcoat 940 is ignored. The fifth term on the right side indicates the heat loss in the form of emissions from the fuse element 920.

Then, as can be seen from expression (1), the energy obtained by subtracting the heat loss energy of the first to fifth terms on the right side from the heat generation energy of the first term on the right side balances out with the heat absorption energy of the fuse element 920 on the left side. In fact, once the physical properties and geometry dimensions of the fuse element 920 and the support substrate 910, etc. are determined, it is conceived that the temperature elevation $\Delta\theta_e$ due to conduction of the fuse element 920 reaches the temperature elevation $\Delta\theta_m$ to the melting point of the fuse element 920 and that the melting occurs, despite there being various heat losses, by increasing the conduction current I and the conduction time T in expression (1) to values larger than predetermined values.

Here, if it is assumed that the second to fifth terms on the right side of expression (1) are all zero and that the fuse element 920 reaches the melting point and thus, $\Delta\theta_e=\Delta\theta_m$, then expression (1) is reduced to the following expression (2):

$$C_v\cdot V\cdot\Delta\theta_m=R\cdot I^2\cdot T \tag{2}$$

Moreover, when the expression (2) is modified and the common logarithms of both sides are taken, the following expression (3) is obtained:

$$\mathrm{Log}(I)=-\tfrac{1}{2}\,\mathrm{Log}(T)+X$$

$$X=\mathrm{Log}(C_v\cdot V\cdot\Delta\theta_m/R) \tag{3}$$

Based on expression (3), it is estimated that, when there is no heat loss, the pre-arcing time-current characteristic curve with conduction time T along the horizontal axis (axis with a logarithmic scale) and melting current I along the vertical axis (axis with a logarithmic scale) approaches a straight line with a slope of −½, and that the melting current I decreases as the conduction time T increases. On the other hand, when the total value of heat loss is not zero, the pre-arcing time-current characteristic curve deviates from the straight line with a slope of −½. It is also estimated that when the total value is small, the deviation is also small such that the minimum melting current value is small, whereas, when the total value is large, the deviation is also large such that the minimum melting current value is large.

As for the volume V and resistance R of the fuse element 920, they are respectively expressed by the following expressions (4) and (5):

$$V=A_0\cdot L \tag{4}$$

$$R=\rho\cdot(L/A_0) \tag{5}$$

wherein ρ denotes the resistivity of the fuse element 920.

When the above-described expressions (4) and (5) are substituted in expression (1) and sorted out, the following expression (6) is obtained:

$$C_v\cdot\Delta\theta_e=\rho\cdot(I/A_0)^2\cdot T-\lambda_1\cdot(2\Delta\theta_1/L^2)T-\lambda_2\cdot(A_{S1}/V)\cdot\Delta\theta_2/h_1\cdot T-\lambda_3\cdot(A_{S2}/V)\cdot\Delta\theta_3/h_2\cdot T-\sigma\cdot\varepsilon\cdot F\cdot(A_S/V)\{(\theta_4)^4-(\theta_5)^4\}T \tag{6}$$

Here, if it is assumed that the second to fifth terms on the right side of expression (6) are all zero and that the fuse element 920 reaches the melting point and thus, $\Delta\theta_e=\Delta\theta_m$, then expression (6) is reduced to the following expression (7):

$$C_v\cdot\Delta\theta_m=\rho\cdot(I/A_0)^2\cdot T \tag{7}$$

Moreover, when the expression (7) is modified and the common logarithms of both sides are taken, the following expression (8) is obtained:

$$\mathrm{Log}(I/A_0)=-\tfrac{1}{2}\,\mathrm{Log}(T)+Y$$

$$Y=\mathrm{Log}(C_v\cdot\Delta\theta_m/\rho) \tag{8}$$

Based on expression (8), it is estimated that, when there is no heat loss, as with the pre-arcing time-current characteristic curve, the melting current density characteristic curve expressed with conduction time T along the horizontal axis (axis with a logarithmic scale) and melting current density ($I/A_0$) along the vertical axis (axis with a logarithmic scale) approaches a straight line with a slope of −½, and that the value of the melting current density ($I/A_0$) decreases as the conduction time T increases. On the other hand, when the total value of heat loss is not zero, the melting current density characteristic curve deviates from the straight line with a slope of −½. It is also estimated that when the total value is small, the deviation is also small such that the minimum melting current density value is small, whereas, when the total value is large, the deviation is also large such that the minimum melting current density value is large. It should be noted that, since the melting current density is beneficial in comparison study of the pre-arcing time-current characteristics among fuse elements 920 with different cross-sectional areas, the melting current density was utilized in the studies described below.

<3. Studies Leading Up to the Invention of the Present Application>

Based on the above-described theoretical analysis, the inventors conducted various studies in order to lead to the configuration of the chip fuse according to the invention of the present application shown in FIG. 1. The first to fourth such studies will be described hereinafter.

(3-1. First Study)

In order to reduce the melting current and the melting current density, it is effective to reduce the heat loss, namely, to make the second to fifth terms on the right side of the above-described expression (6) very small. Hence, the inventors have worked on the microminiaturization of the second to fifth terms on the right side of expression (6) and obtained the following experimental results.

First, the experimental results obtained by working on the microminiaturization of the second term on the right side will be described. This experiment was carefully carried out such that the values of the factors other than the length L of the fuse element 920 in expression (6) would not vary.

Figure 7:
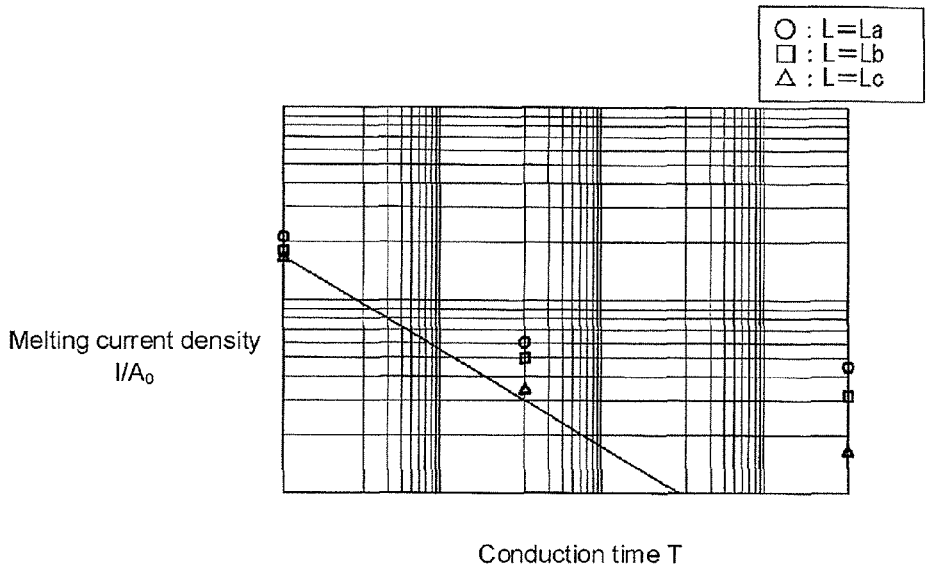
FIG. 7 is a graph showing experimental results.

FIG. 7 is a graph showing the experimental results. The graph shows the experimental results of when the length L of the fuse element 920 is set to length La, Lb or Lc. It should be noted that the lengths La, Lb and Lc have the relationship of Lc>Lb>La. As can be seen from the graph, in accordance with an increase in the length L, in the region of the graph where the conduction time T is small, the deviation from the straight line with a slope of −¼ decreases and the melting current density is also reduced.

Figure 8:
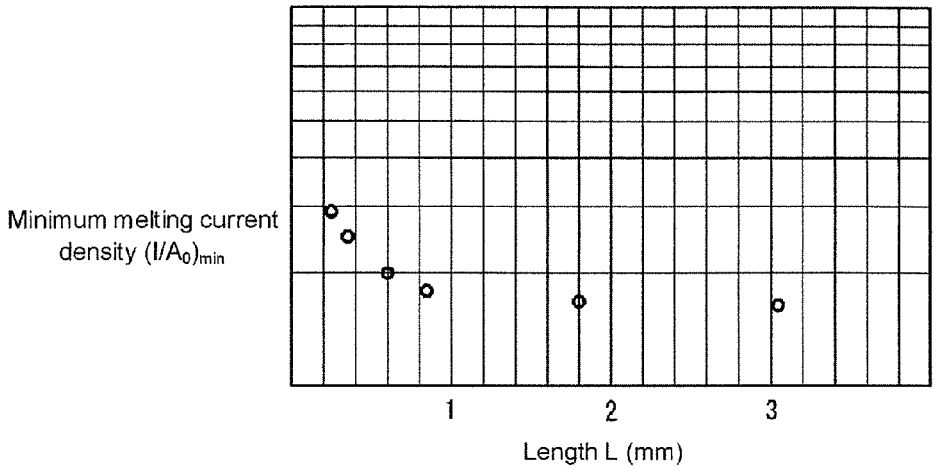
FIG. 8 is a graph showing the relationship between the fuse element length and the minimum melting current density, which is derived from the experimental results of FIG. 7.

FIG. 8 is a graph showing the relationship between the length of the fuse element 920 and the minimum melting current density thereof derived from the experimental results of FIG. 7. As can be seen from the graph, it was confirmed that, as the length L increases, the minimum melting current density $(I/A_0)_{min}$ decreases and the minimum melting current density tends to be saturated when the length L is approximately 600 (μm) or longer. Accordingly, the inventors determined that it is necessary to ensure 600 (μm) or longer for the length L of the fuse element 920.

Next, the experimental results obtained by working on the microminiaturization of the third term on the right side will be described. As described above, the third term on the right side indicates the heat loss due to heat transfer from the fuse element 920 to the support substrate 910. Accordingly, the inventors thought that the heat loss can be reduced if the thermal conductivity $\lambda_2$ of the support substrate is reduced, and they carefully conducted the experiment such that the values of the factors other than the thermal conductivity $\lambda_2$ in expression (6) would not vary.

In the experiment, as the support substrate 910, an alkali-free glass substrate with a thermal conductivity $\lambda_2$ of approximately 1.5 (W/(mK)) at room temperature, a polyimide substrate with a thermal conductivity $\lambda_2$ of approximately 0.16 (W/(mK)), and a layered clay substrate containing montmorillonite as the principal component, with a thermal conductivity $\lambda_2$ of approximately 0.20 (W/(mK)), were used. On this occasion, the thickness of the respective substrates was set as the same thickness of approximately 50 (μm). In this experiment, as the overcoat 940, an overcoat mainly containing silicone resin, with a thermal conductivity of approximately 0.20 (W/(mK)) at room temperature, was used.

It should be noted that the thermal conductivity $\lambda_2$ of the polyimide substrate and the alkali-free glass substrate was determined by measuring with a laser flash method. The thermal conductivity $\lambda_2$ of the layered clay substrate was determined by measuring the thermal diffusivity κ with a temperature wave thermal analysis method and measuring the constant pressure specific heat $C_p$ with a differential scanning calorimetry (DSC) method, and then by calculating expression $\lambda_2=\kappa\times C_p\times a$ (wherein a is density).

Figure 9:
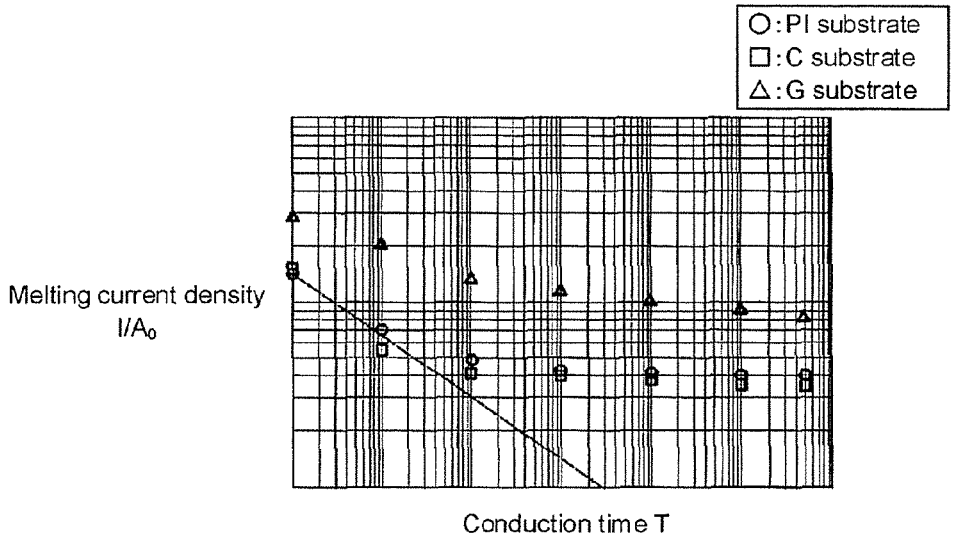
FIG. 9 is a graph showing experimental results.

FIG. 9 is a graph showing the experimental results. As can be seen from the graph, it was confirmed: that the pre-arcing time-current characteristics in the cases with the polyimide substrate (PI substrate in FIG. 9) and the layered clay substrate (C substrate) have a reduced deviation from the straight line with a slope of −⅓ in the region where the conduction time T is small, as compared to the pre-arcing time-current characteristic in the case with the alkali-free glass substrate (G substrate); and that the melting current density is reduced in conjunction therewith. Accordingly, the inventors determined that it is necessary to make the thermal conductivity $\lambda_2$ of the support substrate be approximately 0.30 (W/(mK)) or less at room temperature, or, desirably, it is preferable for it to be 0.20 (W/(mK)) or less.

Next, the experimental results obtained by working on the microminiaturization of the fourth term on the right side will be described. As described above, the fourth term on the right side indicates the heat loss due to heat transfer from the fuse element 920 to the overcoat 940. Accordingly, the inventors thought that the heat loss can be reduced if the thermal conductivity $\lambda_3$ of the overcoat 940 is reduced, and they carefully conducted the experiment such that the values of the factors other than the thermal conductivity $\lambda_3$ in expression (6) would not vary.

In the experiment, as the overcoat 940, an overcoat containing low melting point glass (hereinafter referred to as G coat) with a thermal conductivity $\lambda_3$ of approximately 1.0 (W/(mK)) at room temperature, an overcoat consisting of epoxy resin and inorganic material (hereinafter referred to as EP coat) with a thermal conductivity $\lambda_3$ of approximately 0.5 (W/(mK)), and an overcoat mainly containing silicone resin (hereinafter referred to as Si coat), with a thermal conductivity λ3 of approximately 0.2 (W/(mK)), were used. In this experiment, a polyimide substrate was used as the support substrate 910.

Figure 10:
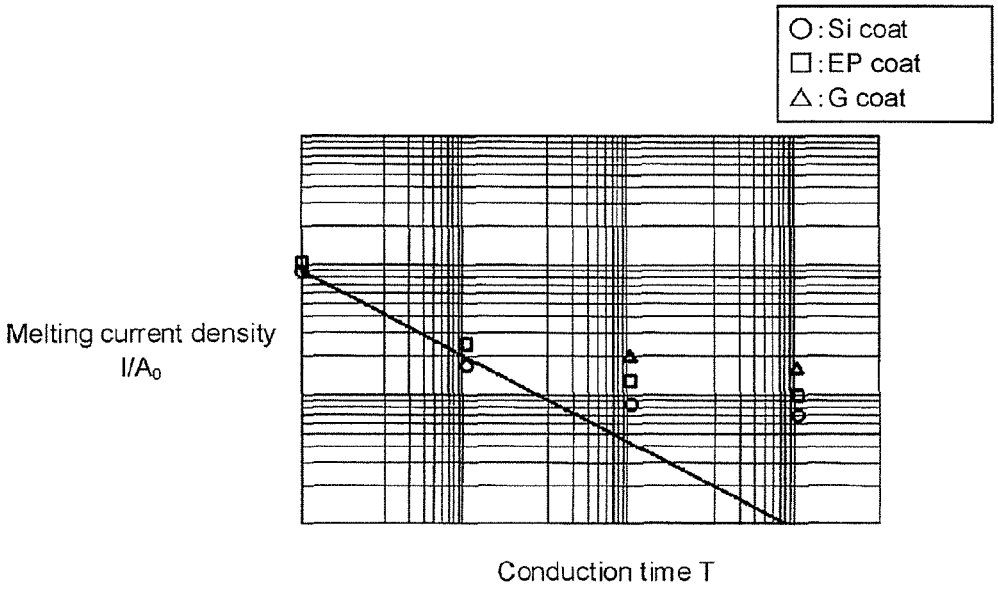
FIG. 10 is a graph showing experimental results.

FIG. 10 is a graph showing the experimental results. As can be seen from the graph, it was confirmed that, as the thermal conductivity $\lambda_3$ of the overcoat 940 decreases (in particular, decreases from approximately 1.0 (W/(mK)) to 0.2 (W/(mK))), deviation from the straight line with a slope of −⅓ in the region where the conduction time T is small is reduced, and that the melting current density is reduced in conjunction therewith.

Incidentally, through the experiments above, the inventors found that suppressing the value of the thermal conductivity $\lambda_2$ of the support substrate 910 and the value of the thermal conductivity $\lambda_3$ of the overcoat within a range such that there is no significant difference between the two values is effective for the above-described reduction in the deviation from the straight line with a slope of −⅓ and for the reduction in the melting current density. For example, even when the thermal conductivity $\lambda_2$ was reduced, if the thermal conductivity $\lambda_3$ was not reduced, the effect was limited. Similarly, even when the thermal conductivity $\lambda_3$ was reduced, if the thermal conductivity $\lambda_2$ was not reduced, the effect was also limited. It was most effective when the thermal conductivity $\lambda_2$ and the thermal conductivity $\lambda_3$ were made to have substantially the same, and small, value. For this reason, the inventors determined that it is necessary to make the thermal conductivity $A_2$ and the thermal conductivity $A_3$ be approximately 0.30 (W/(mK)) or less at room temperature, or, desirably, it is preferable for them to be 0.20 (W/(mK)) or less.

(3-2. Second Study)

The inventors focused on $(A_{S1}/V)$, $(A_{S2}/V)$ and $(A_S/V)$ included in the third to fifth terms on the right side in expression (6). The inventors determined that if $(A_{S1}/V)$, $(A_{S2}/V)$ and $(A_S/V)$ can be reduced, the third to fifth terms would be reduced, and thus, the melting current density $(I/A_0)$ of the first term on the right side could also be reduced.

Here, V is the volume of the fuse element 920 and $A_S$ is the surface area of the fuse element 920, and thus, $A_S/V$ denotes the specific surface area (surface area per unit volume) of the fuse element 920. Further, $A_{S1}$ is the area where the fuse element 920 makes contact with the support substrate 910 and $A_{S2}$ is the area where the fuse element 920 makes contact with the overcoat 940, and thus, $(A_{S1}/V)$ and $(A_{S2}/V)$ also have the same dimension [/length] as the specific surface area $A_S/V$. Hereinafter, it is defined that $\xi_1=A_s/V$, $\xi_2=A_{s1}/V$ and $\xi_3=A_{s2}/V$, and for the sake of description, they are collectively referred to as the specific surface area.

As shown in FIGS. 4 to 6, the fuse element 920 has a reed shape having the thickness t, the width w and the length L with the relationship of t≤w. Then, the volume V of the fuse element 920 is V=t×w×L, the surface area $A_S$ thereof is $A_S=2(w+t)\times L$, and the specific surface area $\xi_1$ of the fuse element 920 is as defined in the following expression (9):

$$\xi_1=A_S/V=2\{1+(t/w)\}/t \quad (9)$$

Similarly, since the support substrate 910 makes contact with the bottom surface of the fuse element 920, the contact area $A_{S1}$ is $A_{S1}=w\times L$, and thus, the specific surface area 42 is as defined in the following expression (10):

$$\xi_2=A_{S1}/V=1/t \quad (10)$$

Further, since the overcoat 940 makes contact with the upper surface and two side surfaces in the width direction of the fuse element 920, the contact area $A_{S2}$ is $A_{S2}=(2t+w)\times L$. Accordingly, the specific surface area $\xi_3$ is as defined in the following expression (11):

$$\xi_3=A_{S2}/V=\{1+2(t/w)\}/t \quad (11)$$

As can be seen from expressions (9) to (11), it is important that the thickness t is not reduced more than necessary in order to suppress the increase in the specific surface areas $\xi_1$, $\xi_2$ and $\xi_3$. For the specific surface areas $\xi_1$ and $\xi_3$, it is also necessary to give consideration to the t/w ratio.

Figure 11:
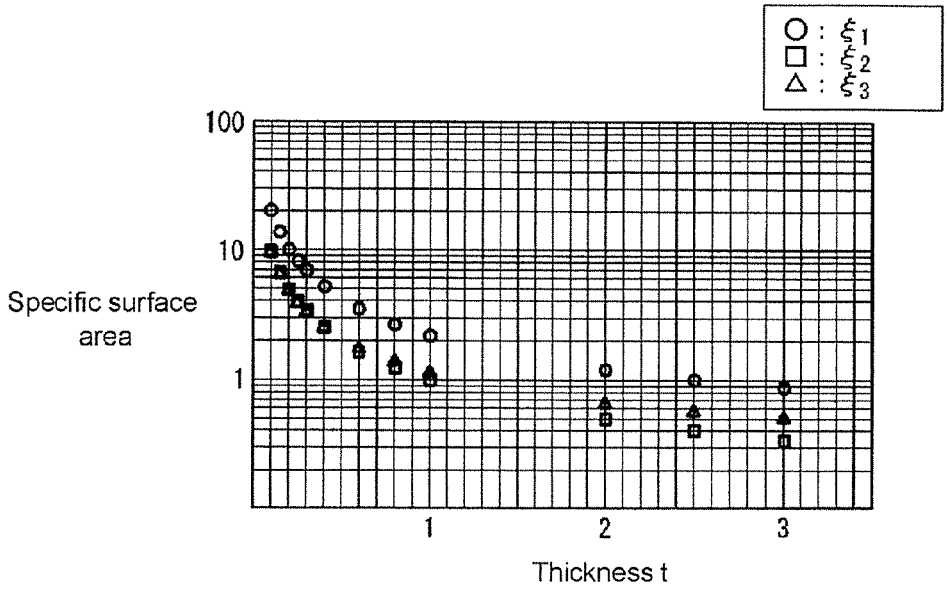
FIG. 11 is a graph showing an example of the relationship between the thickness t of the fuse element 920 and the specific surface areas $\xi_1$, $\xi_2$, $\xi_3$ thereof.

FIG. 11 is a graph showing the relationship between the thickness t of the fuse element 920 and the specific surface areas $\xi_1$, $\xi_2$ and $\xi_3$ thereof, in the case where the width w of the fuse element 920 is set to 10 (μm). The description is given by taking the specific surface area $\xi_1$ as an example. When the thickness t varies from 0.1 (μm) to 3.0 (μm), the specific surface area $\xi_1$ varies from approximately 21 (/μm) to approximately 0.87 (/μm). The other specific surface areas $\xi_2$ and $\xi_3$ showed the same tendency, and it was confirmed that the specific surface area increases with the microminiaturization of the thickness t.

Figure 12:
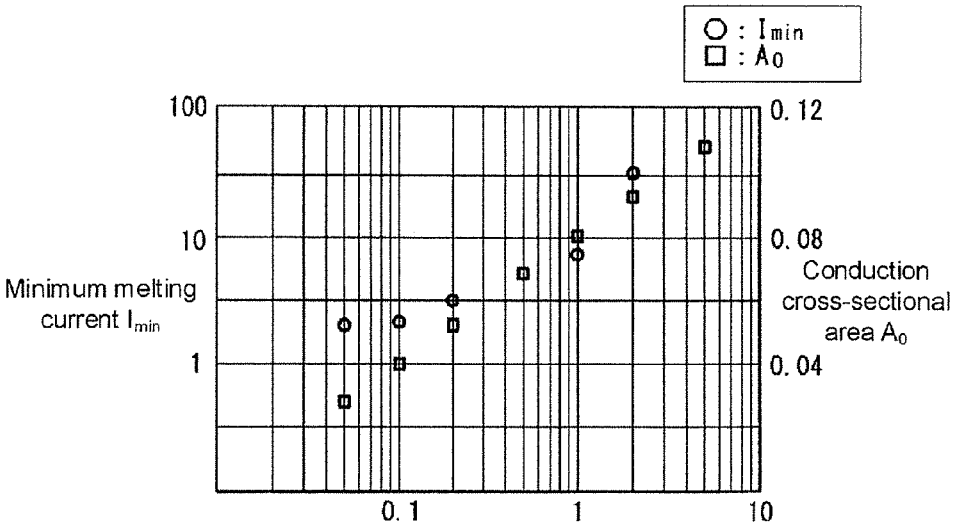
FIG. 12 is a graph showing the relationship between: the thickness t of the fuse element 920; and the minimum melting current $I_{min}$ and the conducting cross-sectional area $A_0$ thereof.

The inventors produced a chip fuse 900 having integrated therein the fuse element 920 with the width w of 10 (μm) and the thickness t of 0.1 (μm)-3.0 (μm) and carried out a melting experiment. The graph indicating the correlation such as shown in FIG. 12 was derived from the experimental results. FIG. 12 is the graph showing the relationship between: the thickness t of the fuse element 920; and the minimum melting current and the conducting cross-sectional area. It should be noted that the scale of the left vertical axis of the graph in FIG. 12 is also logarithmic. As can be seen from the graph, the conducting cross-sectional area $A_0$ of the fuse element 920 decreases in proportion to the microminiaturization of the thickness t. On the other hand, it was confirmed: that the minimum melting current $I_{min}$ decreases with the microminiaturization of the thickness t; however, the decreasing rate of the minimum melting current $I_{min}$ tends to be saturated as the thickness t is reduced; and that, when the thickness t is 0.1 (μm) or less, the minimum melting current $I_{min}$ scarcely decreases.

Figure 13:
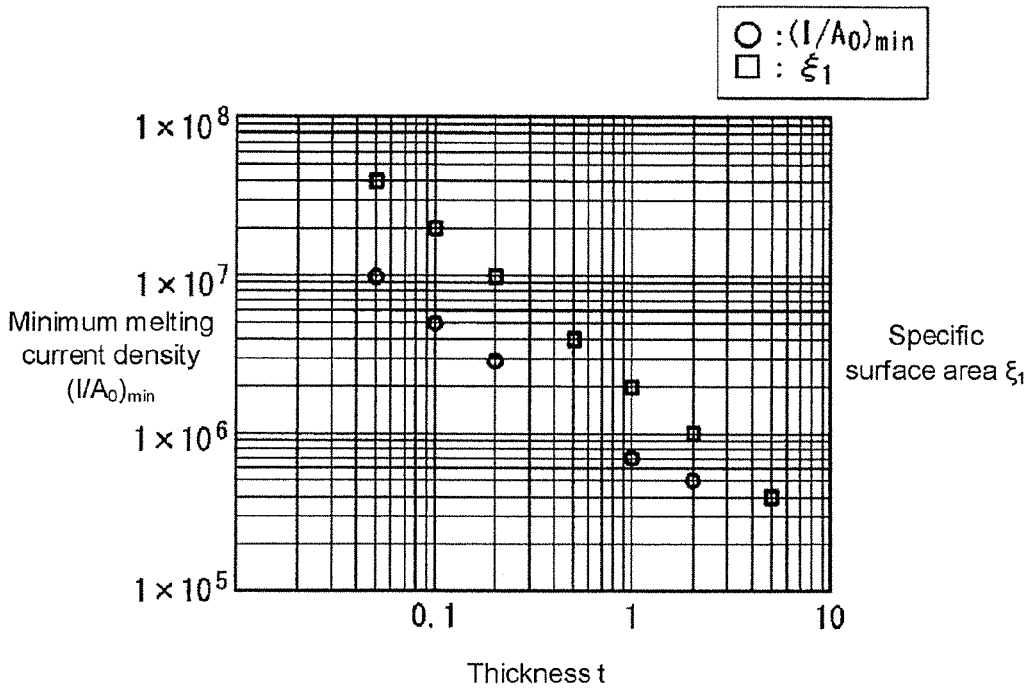
FIG. 13 is a graph showing the relationship between: the thickness t of the fuse element 920; and the minimum melting current density $(I/A_0)_{min}$ and the specific surface area $\xi_1$ thereof.
Figure 14:
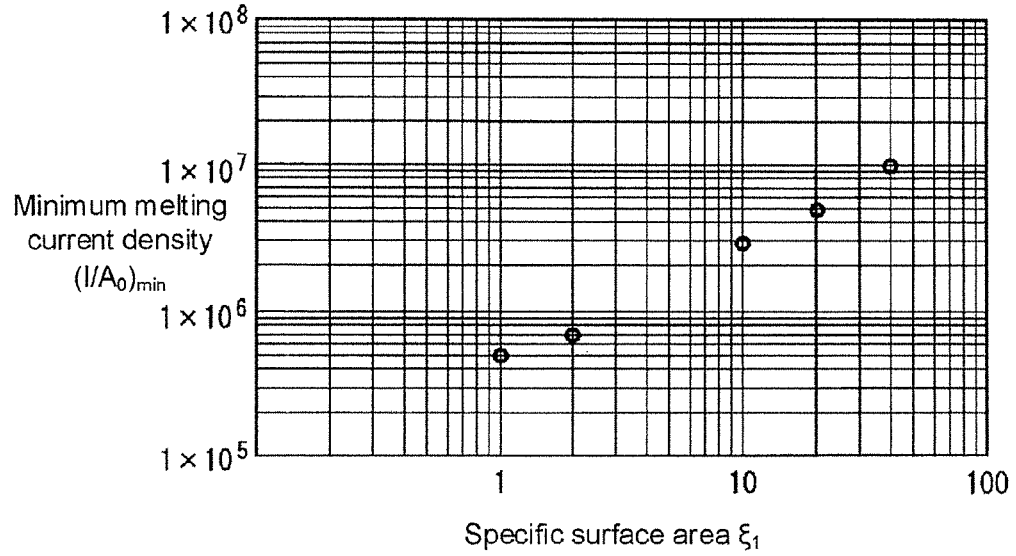
FIG. 14 is a graph showing the relationship between the specific surface area $\xi_1$ and the minimum melting current density $(I/A_0)_{min}$.

Moreover, the inventors derived the graphs showing the correlations such as shown in FIGS. 13 and 14 from the above-described experiment. FIG. 13 is a graph showing the relationship between: the thickness t of the fuse element 920; and the minimum melting current density $(I/A_0)_{min}$ and the specific surface area $\xi_1$. As can be seen from the graph, the specific surface area $\xi_1$ and the minimum melting current density $(I/A_0)_{min}$ increase in proportion to the reduction in the thickness t. In this way, experimental results were obtained that support the above-described analysis results.

FIG. 14 is a graph showing the relationship between the specific surface area $\xi_1$ and the minimum melting current density $(I/A_0)_{min}$. As can be seen from the graph, it was confirmed that; there is an explicit correlation between the specific surface area $\xi_1$ and the minimum melting current density $(I/A_0)_{min}$; and that it is necessary to suppress the increase in the specific surface area $\xi_1$ in order to suppress the increase in the minimum melting current density $(I/A_0)_{min}$. It should be noted that, although the description thereof is omitted in the above, it was also confirmed that the same applies to the specific surface areas $\xi_2$ and $\xi_3$ with the specific surface area $\xi_1$.

Based on the above-described first and second studies, the inventors obtained knowledge to the effect that, for suppressing heat loss in order to realize the microminiaturization of the minimum melting current density $(I/A_0)_{min}$, it is necessary to: secure the length L of the fuse element 920; make the thermal conductivity $\lambda_2$ of the support substrate 910 and the thermal conductivity $\lambda_3$ of the overcoat 940 to be a predetermined value or less; and make the specific surface areas $\xi_1$-$\xi_3$ fall within a predetermined range (in particular, 21 (/μm) or less). When considering the above-described thickness t and the range of the specific surface areas $\xi_1$-$\xi_3$, as can be seen from FIGS. 13 and 14, the minimum melting current density $(I/A_0)_{min}$ becomes $4.0\times10^6$ (A/cm$^2$) or less. Desirably, it is preferable for the minimum melting current density $(I/A_0)_{min}$ to be $3.5\times10^6$ (A/cm$^2$) or less.

(3-3. Third Study)

The inventors also addressed the microminiaturization of the minimum melting current $I_{min}$. When the minimum melting current density $(I/A_0)_{min}$ and the conducting cross-sectional area $A_0$ are used, the minimum melting current $I_{min}$ is expressed as the following expression (12):

$$I_{min}=(I/A_0)_{min}\cdot A_0 \quad 12)$$

As can be seen from expression (12), the microminiaturization of the minimum melting current density $(I/A_0)_{min}$ and the microminiaturization of the conducting cross-sectional area $A_0$ are effective for microminiaturization of the minimum melting current $I_{min}$; namely, for reducing the capacity of the chip fuse 900. Since it is considered that the specific surface areas $\xi_1$-$\xi_3$ increase with the microminiaturization of the conducting cross-sectional area $A_0$, the inventors took an approach of microminiaturizing the conducting cross-sectional area $A_0$ without increasing the specific surface areas as much as possible.

As described with the above-indicated expressions (9) to (11), the values of the specific surface areas $\xi_1$-$\xi_3$ vary depending on the values of the thickness t and the width w of the fuse element 920. Hence, the inventors studied the correlations among the width w, the thickness t, and the specific surface areas $\xi_1$-$\xi_3$ of the fuse element 920 having a predetermined conducting cross-sectional area.

FIG. 15 is a table summarizing the correlations among the width w, the thickness t and the specific surface areas $\xi_1$-$\xi_3$ of the fuse element 920 having a predetermined conducting cross-sectional area (here, 1 (μm$^2$)). As shown in the table, under the condition of t≤w, it can be seen that the values of the specific surface areas $\xi_1$-$\xi_3$ approach the minimum value when the t/w ratio, which represents the cross-sectional shape, approaches from 0.0001 to 1, which corresponds to a square. Accordingly, the t/w ratio with a value that is as close to 1 as possible is effective for securing a predetermined conducting cross-sectional area and for suppressing the increase in the specific surface areas $\xi_1$-$\xi$.

Regarding the actual influence of the t/w ratio on the minimum melting current density $(I/A_0)_{min}$, the inventors carried out an experiment using test samples. The experimental results are shown in FIG. 16. FIG. 16 is a table summarizing the relationship between the t/w ratio and the minimum melting current density $(I/A_0)_{min}$. As the test samples, three samples were used, each having substantially the same conducting cross-sectional area and a different cross-sectional shape (t/w ratio) with respect to each other. As shown in the table, it was confirmed that the larger the t/w ratio is; namely, the more it approaches 1, the smaller the minimum melting current density $(I/A_0)_{min}$ is.

By looking at the above-described experimental results, it became clear that it is important to control the t/w ratio in order to microminiaturize the minimum melting current $I_{min}$ and that it is particularly effective when the t/w ratio satisfies the relationship of $0.01<t/w\leq 1$.

(3-4. Fourth Study)

For the chip fuse 900, rush resistance is required such that the chip tolerates the rush current (also referred to as the inrush current) and will not melt. The rush current is a current that occurs at the time of switching on and/or off the power supply of an electric circuit. The rush current often occurs, for example, due to the charging and/or discharging of a capacitor inserted to the electric circuit. Due to the rush current, the chip fuse 900, which would not melt under normal circumstances, may melt.

Figure 17:
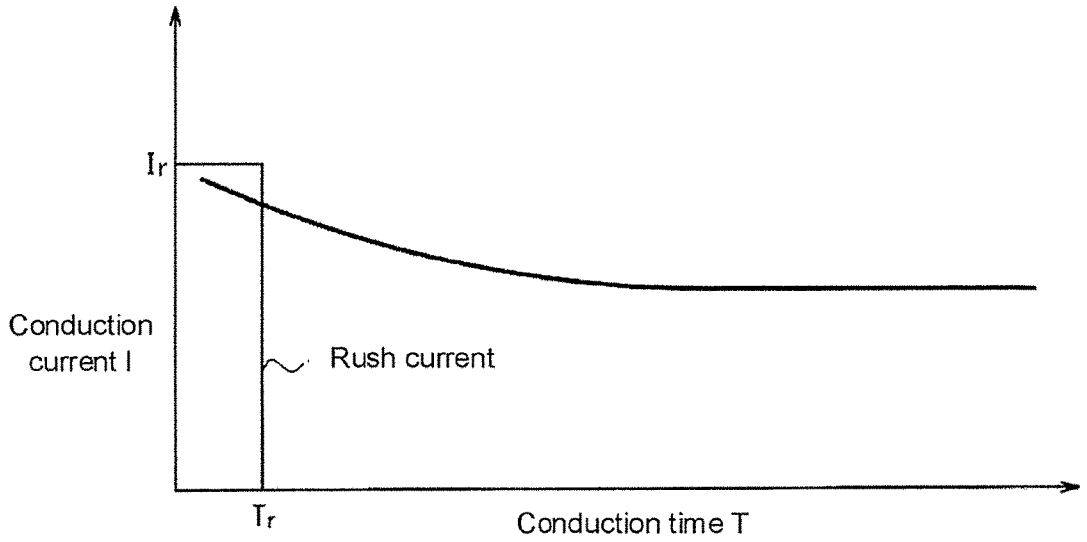
FIG. 17 is a diagram for explaining the relationship between the rush current and the pre-arcing time-current characteristic curve.

FIG. 17 is a diagram for explaining the relationship between the rush current and the pre-arcing time-current characteristic curve. The rush current has characteristics that it has a spike-like current waveform, a high current peak and a short conduction time. When it is defined that the pulse width of the rush current is $T_r$ and the current value thereof is $I_r$, FIG. 17 shows that the pulse width $T_r$ corresponds to the horizontal axis of the pre-arcing time-current characteristic and the current value $I_r$ corresponds to the vertical axis.

FIG. 17 shows the pre-arcing time-current characteristic curve of the chip fuse 900; however, this pre-arcing time-current characteristic curve has, unlike the pre-arcing time-current characteristic curve of the chip fuse 1 according to the present embodiment shown in FIG. 3, a gentle slope in the region where the conduction time T is small. Accordingly, when an attempt is made to reduce the minimum melting current, at which the conduction current of the chip fuse 900 becomes substantially horizontal, the value of conduction current in the region where the conduction time T is reduced is also reduced. Therefore, as shown in FIG. 17, when the conduction time T is small (specifically, when it is smaller than the conduction time $T_r$), the rush current exceeds the pre-arcing time-current characteristic curve and the chip fuse 900 melts. It should be noted that, as described above, the reason why the slope of the pre-arcing time-current characteristic curve of the chip fuse 900 becomes gentle is due to the heat loss. Accordingly, reduction in heat loss is effective for increasing the rush resistance of the chip fuse 900.

On the other hand, according to the above-described studies, it became clear that the reduction in capacity of the chip fuse 900 can be achieved by means of microminiaturization of the fuse element 920; however, the heat loss is increased due to the increase in the specific surface areas $\xi_1$-$\xi_3$ (see expression (6)) and thus, that the rush resistance is reduced. Namely, it can be said that the reduction in capacity of the chip fuse 900 and the improvement in rush resistance have an inverse relationship. Accordingly, after numerous considerations, the inventors found that there is a room for improvement in the cross-sectional shape of the fuse element 920 in order to achieve both the reduction in capacity and the improvement in rush resistance of the chip fuse 900.

In order to suppress the increase in the specific surface areas $\xi_1$-$\xi_3$, the cross-sectional shape of the fuse element 920 is ideally square (w=t). For example, the conducting cross-sectional area required for achieving the minimum melting current of 100 (mA) is approximately 6 ($\mu m^2$). The length of one side (i.e. the thickness t or the width w) of the square in such case is approximately 2.45 (μm). Then, thickness t is desirably approximately 2.45 (μm) or less for achieving the minimum melting current of 100 (mA) or less. On the other hand, the lower limit of the thickness t for making the specific surface areas $\xi_1$-$\xi_3$ assume the value of 21 (/μm) or less is approximately 0.1 (μm). Accordingly, it became clear that the thickness t for achieving the minimum melting current of 100 (mA) or less is desirably 0.1 (μm)-2.45 (μm). It should be noted that, although the detailed description will be provided hereinafter, the thickness t is desirably b.1 (μm)-3.0 (μm) for securing the productivity of the fuse element 920.

It became clear that a chip fuse with a reduced capacity and an improved rush resistance can be achieved if the above-described first to fourth studied matters can be applied. The chip fuse 1 according to the present embodiment shown in the above-described FIGS. 1 to 3 is a chip fuse applied with the first to fourth studied matters. Namely, the chip fuse 1 secures a predetermined length or longer for the length L of the fuse film 20, the thermal conductivity $\lambda_2$ and the thermal conductivity $\lambda_3$ are kept at or under a predetermined value, and the specific surface areas $\xi_1$-$\xi_3$ are kept at or under a predetermined value. Here, the rush resistance and the reduction in capacity of the chip fuse 1 will be described with reference to FIG. 3. With conventional chip fuses, it is difficult to make the minimum melting current value to be 100 (mA) or lower. In contrast to this, according to the present embodiment, as described with FIG. 3, the conduction current $I_{min}$ at point C is 85 (mA) and thus, the minimum melting current is 100 (mA) or less, and therefore, the reduction in capacity of chip fuse 1 is achieved. In addition, since the conduction current $I_A$ at point A is 300 (mA), $I_A/I_{min}$ is approximately 3.5, and thus, a high rush resistance to the rush current is secured. Moreover, when a straight line A-D is drawn by connecting points A and D, which are two points representing the pre-arcing time-current characteristic curve such as shown in FIG. 3, with the conventional chip fuse with a small minimum melting current, the conduction current $I_A$ at point A is also small, and thus, the slope of the straight line A-D was more gentle than −⅓. In contrast to this, according to the present embodiment, the slope of the straight line A-D is steeper than approximately −⅓, and thus, the rush resistance of the chip fuse 1 can be further confirmed. Based on the above, the chip fuse 1 has an improved rush resistance while achieving the minimum melting current of 100 (mA) or less.

<4. Method for Manufacturing a Chip Fuse>

Figure 18:
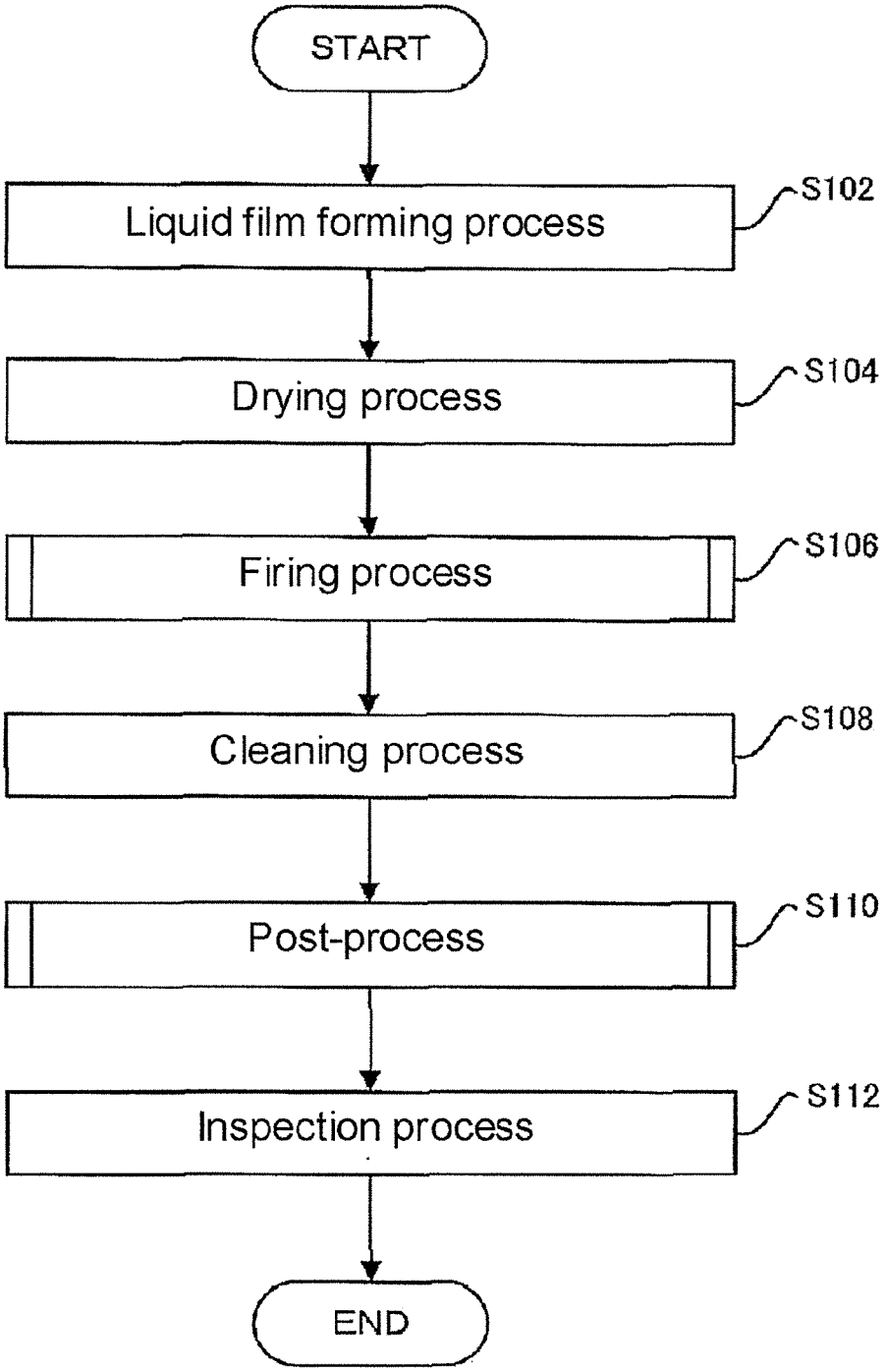
FIG. 18 is a flowchart showing the manufacturing process of the chip fuse 1.

An example of the method for manufacturing the chip fuse 1 will now be described with reference to FIG. 18. FIG. 18 is a flowchart showing the manufacturing process of the chip fuse 1. As shown in FIG. 18, the method for manufacturing the chip fuse 1 includes a liquid film forming process, a drying process, a firing process, a cleaning process, a post-process and an inspection process. Each process will be described hereinafter.

(Liquid Film Forming Process S102)

Figure 19:
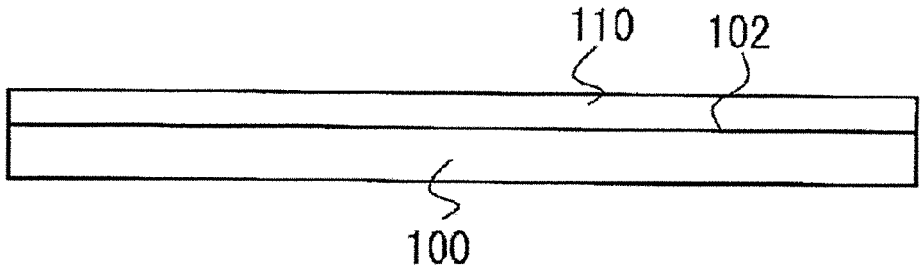
FIG. 19 is a schematic diagram showing an ink film 110 formed on an aggregated substrate 100.

A liquid film of dispersion liquid with metal nanoparticles dispersed therein is formed on a surface 102, which is the principal surface of an aggregated substrate 100 (see FIG. 19). More specifically, ink containing the metal nanoparticles is formed only to a predetermined thickness over the surface 102 of the aggregated substrate 100 using a spin-coater (not shown). Thereby, an ink film is formed on the surface 102.

As the metal nanoparticles, for example, silver nanoparticles are used. The average particle size of the silver nanoparticles is approximately 15 (nm). The content of the silver nanoparticles in the ink (i.e. silver nanoink) is, for example, approximately 50 (wt %). It should be noted that the content of the silver nanoparticles is not limited to the above and it may be, for example, 20-60 (wt %).

FIG. 19 is a schematic diagram showing the ink film 110 formed on the aggregated substrate 100. In the present embodiment, the ink film 110 is formed on the aggregated substrate 100, which corresponds to support substrates of a plurality of chip fuses 1, so that the chip fuse can be mass produced. As the aggregated substrate 100, a polyimide substrate with a thickness of approximately 250 (μm), a surface roughness Ra of approximately 0.05 (μm), and a thermal conductivity of approximately 0.2 (W/(mK)), is used. It should be noted that the publicly-known laser flash method is used for measuring the thermal conductivity of the polyimide substrate.

(Drying Process S104)

In the drying process S104, the ink film 110 on the aggregated substrate 100 is dried. More specifically, the aggregated substrate 100 is dried using a blast heating furnace, for example, at a temperature of approximately 70° C. for approximately one hour or less, and then, a dried nano-silver ink film with a uniform thickness is formed on the aggregated substrate 100.

(Firing Process S106)

In the firing process, the ink film 110 on the aggregated substrate 100 is fired by irradiating the ink film 110 with laser light by means of a laser irradiation apparatus, and then, a fuse film and internal terminal groups are formed. The configuration of the laser irradiation apparatus will be described hereinafter, prior to describing the firing process.

Figure 20:
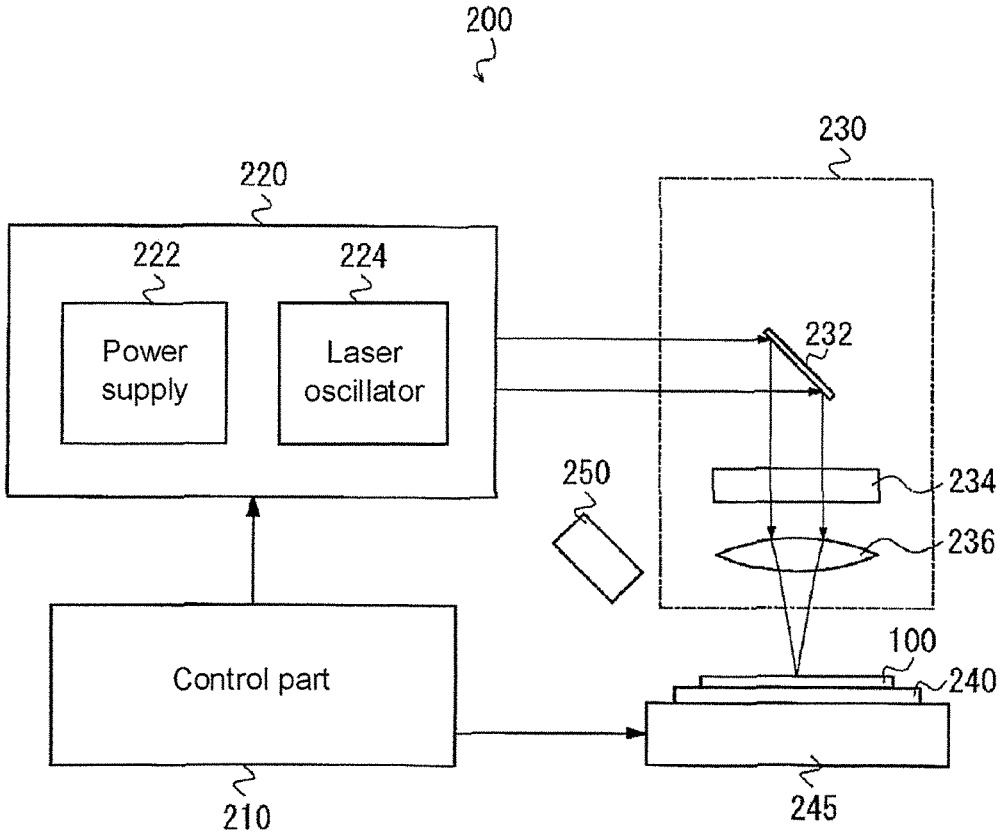
FIG. 20 is a schematic diagram showing an example of the configuration of a laser irradiation apparatus 200.

FIG. 20 is a schematic diagram showing an example of the configuration of the laser irradiation apparatus 200. The laser irradiation apparatus 200 includes a control part 210, a laser output part 220, an optical part 230, a movable table 240, a table driver 245 and a detection part 250.

The control part 210 controls the overall operation of the laser irradiation apparatus 200. For example, when the control part 210 receives CAD information on the fuse film geometry and position from a personal computer, it controls the movement of the movable table 240 and the irradiation of the laser light, and irradiates the ink film on the aggregated substrate 100 with the laser light at a relative scanning velocity. The control part 210 also adjusts the scanning velocity and the irradiation intensity of the laser light.

The laser output part 220 includes a power supply 222 and a laser oscillator 224. The laser oscillator 224 oscillates the laser light in a continuous manner depending on the output from the power supply 222. The laser light is, for example, Nd-YAG laser light with a wavelength of 1,064 (nm). The spot diameter φ (L) of the laser light is, for example, 10 (μm). The average irradiation intensity of the laser light is, for example, $3.0\times10^4$-$5.0\times10^5$ (W/cm$^2$).

The optical part 230 includes a mirror 232, an optical filter 234 and a lens 236. The mirror 232 adjusts the irradiation direction of the laser light. The optical filter 234 has a function of attenuating the light amount of the laser light. The optical filter 234 is, for example, a neutral density (ND) filter. The lens 236 focuses the laser light which is attenuated by the optical filter 234.

The choices for selecting irradiation conditions (e.g. the irradiation intensity) of the laser light are expanded through the use of the above-described optical filter 234. For example, in the case where the average irradiation intensity is controlled to be at $3.0\times10^4$-$5.0\times10^5$ (W/cm$^2$), when the voltage of the power supply 222 is suppressed to a predetermined value or lower, the oscillation of the laser light may become unstable, which poses a problem in the ink film firing. Since an attenuation of the light amount of the laser light is effective for such a problem, the optical filter 234 is used. In addition, the optical filter 234 is detachably attached. Therefore, an appropriate optical filter 234 may be selected and mounted from among optical filters with different characteristics.

The movable table 240 is movable in the X-Y direction. The movable table 240 has a substrate suction part and thus, suctions and holds the aggregated substrate 100. The table driver 245 is of an independent driving type that moves the movable table 240 in each of the X direction and the Y direction, independently. The detection part 250 is, for example, a CCD camera and detects the irradiation status of the laser light on the aggregated substrate 100.

Figure 21:
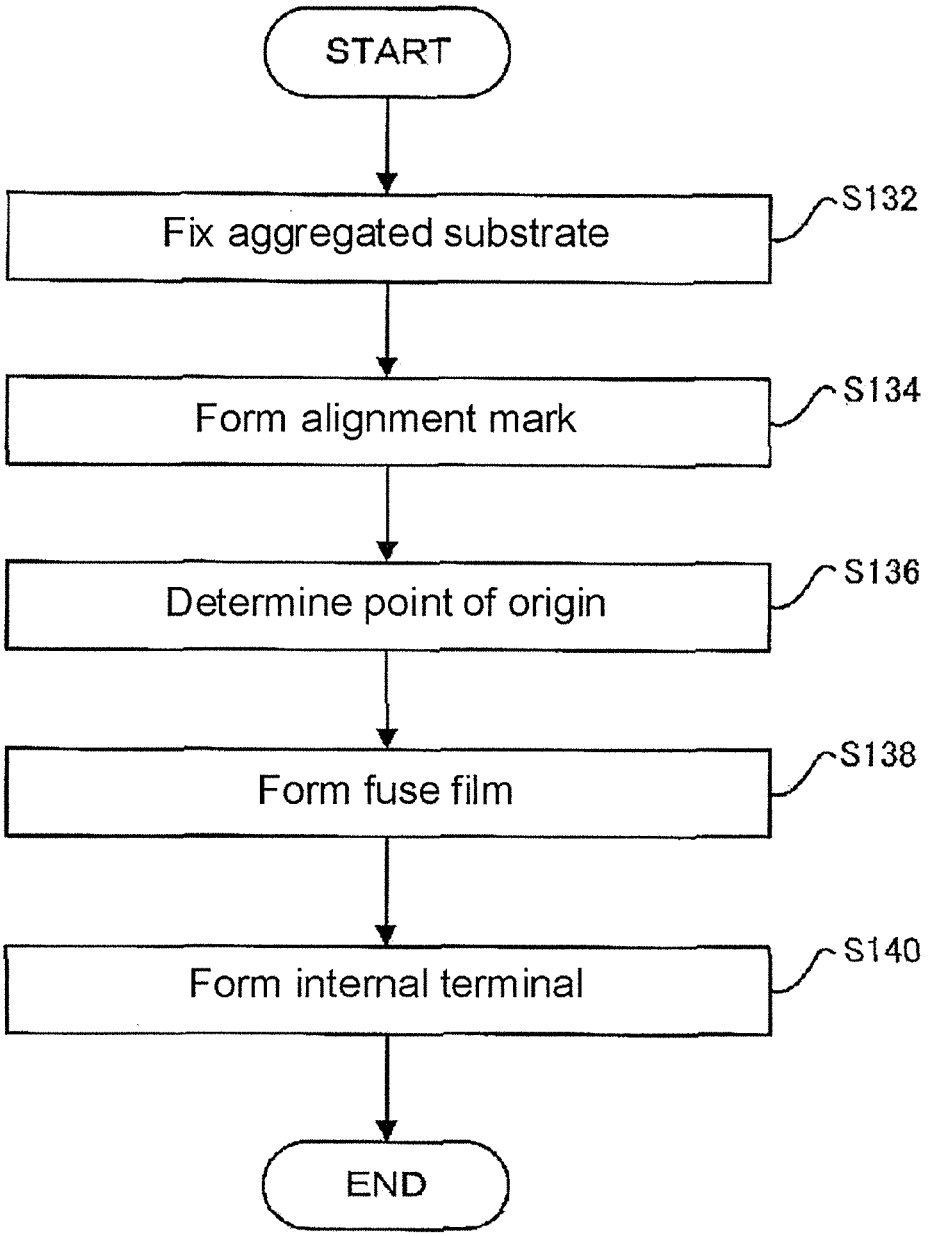
FIG. 21 is a flowchart showing the details of the firing process.
Figure 22:
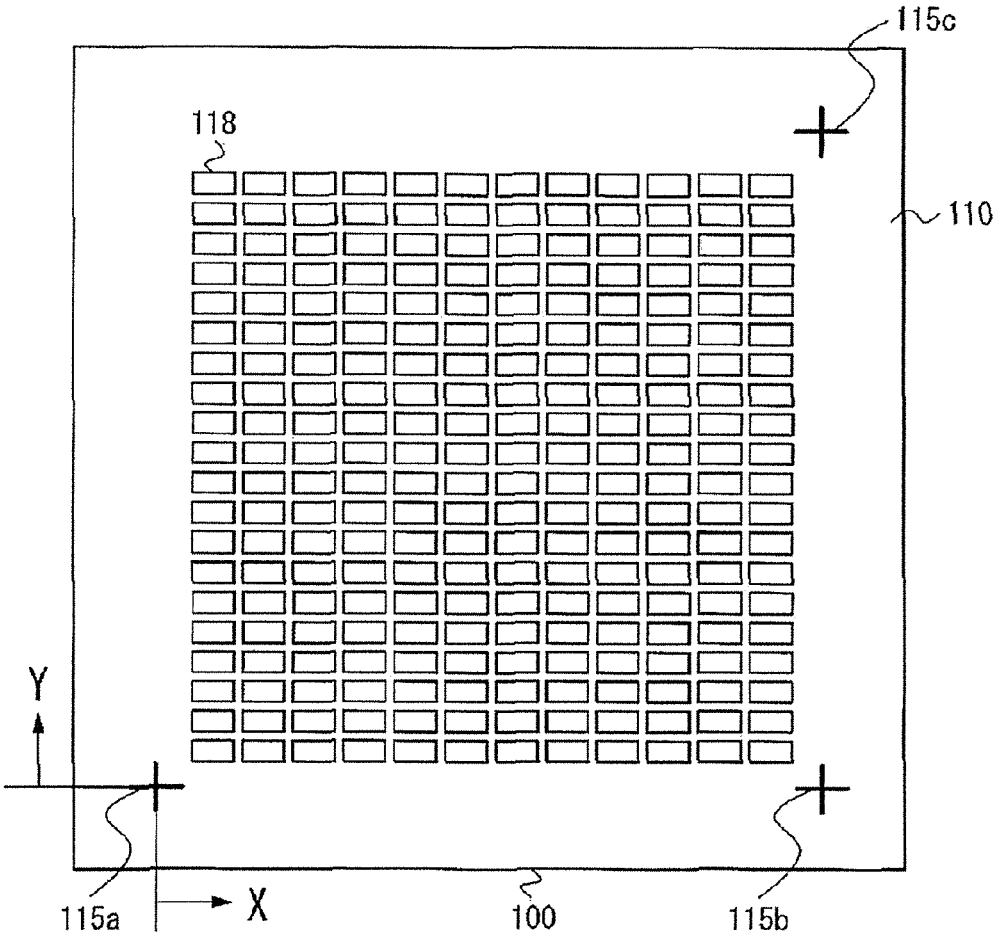
FIG. 22 is a diagram showing the aggregated substrate 100 after the firing.

The configuration of the laser irradiation apparatus 200 is described heretofore. Next, the specific flow of the firing process using the laser irradiation apparatus 200 will be described with reference to FIGS. 21 and 22. FIG. 21 is a flowchart showing the details of the firing process. FIG. 22 is a diagram showing the aggregated substrate 100 after the firing. It should be noted that FIG. 22 schematically shows a sub-assembly 118 that includes a fuse film and internal terminal groups, which correspond to one chip fuse after the firing.

In the firing process, first, the aggregated substrate 100 with the ink film formed on the surface is suctioned and fixed to the movable table 240 (step S132). Next, the laser light is irradiated onto the corners of the ink film on the aggregated substrate 100 to form alignment marks 115*a*, 115*b* and 115*c*, as shown in FIG. 21 (step S134). The formed alignment marks 115*a*-115*c* may be substantially cross shaped. Here, the alignment marks refer to positional adjustment marks for adjusting forming positions for forming a plurality of fuse films on the aggregated substrate 100.

Next, the detection part 250 reads the three alignment marks 115*a*-115*c*. Based on the positions of the read alignment marks, the X direction and the Y direction of the aggregated substrate 100 are determined, and at the same time, the point of origin is also determined (step S136). Here, the alignment mark 115*a* is defined as the point of origin.

Next, the ink film 110 is irradiated with the laser light and a plurality of fuse films 120 are formed (step S138). On this occasion, based on the position (i.e. the point of origin) of the alignment mark 115*a*, the plurality of fuse films 120 are formed. Namely, the control part 210 receives the CAD information on the geometry of the fuse film 120 and the position of the fuse film 120 based on the point of origin (i.e. the position of the alignment mark 115*a*) from a personal computer and controls the movement of the movable table and the irradiation of the laser light. For example, the laser light is irradiated substantially perpendicular to the surface of the ink film 110 at a scanning velocity of approximately 3-90 (mm/sec), and the plurality of fuse films 120 are formed. In this way, the portions of the ink film 110 which are irradiated with and fired by the laser light become the fuse films 120.

In the present embodiment, a linear fuse film 120 with a width corresponding to the spot diameter of the laser light is formed by scanning the laser light once over the ink film 110. In this way, a large amount of fuse films 120 can be formed within a short period of time. The formed fuse film 120 has a linear shape that extends in the X-direction. The width w of the fuse film 120 is, for example, approximately 10 (μm) and is substantially the same size as the spot diameter φ (L) of the laser light. The thickness t of the fuse film 120 is, for example 0.35 (μm).

After the laser light irradiation (i.e. after the firing), the thickness (i.e. a second thickness) of the fuse film 120 is smaller than the thickness (i.e. a first thickness) of the ink film 110 prior to the laser light irradiation. Since the correspondence between the first thickness and the second thickness is pre-analyzed by way of experiments, etc., the ink film 110 is formed by adjusting the first thickness based on the correspondence between the first thickness and the second thickness in the process of forming the ink film 110 of the above-described step S102. In this way, the fuse film 120 after the firing is appropriately controlled to have a desired thickness.

Moreover, in the present embodiment, the control part 210 may irradiate the ink film 110 with the laser light by adjusting at least one of the irradiation velocity or the irradiation intensity of the laser light, depending on the thickness of the ink film. In this way, the fuse film 120 with a desired thickness can be formed even when the thickness of the ink film 110 varies.

Further, in the present embodiment, the laser light oscillated by the laser oscillator 224 is attenuated by the attenuating optical filter 234, as described above, and the attenuated laser light is irradiated onto the ink film 110. The laser light oscillation is likely to become unstable when the voltage of the power supply 222 becomes smaller than a predetermined value. Hence, instead of decreasing the voltage of the power supply 222 more than necessary, the light amount is attenuated by means of the optical filter 234, and thus, a desired irradiation intensity can be secured. In this way, since the oscillation of the laser light can be suppressed from becoming unstable, the adverse effect on the firing of the ink film 110 can be suppressed.

It should be noted that a linear fuse film 120 is formed in the description above; however, the present invention is not limited to this, and, for example, a curved fuse film may be formed. The curved fuse film may be formed by providing a galvanic mirror in the optical part 230 and scanning the laser light. Alternatively, a fuse film in which a straight line and a curved line are combined may also be formed. In this way, a chip fuse having various shaped fuse films 120 can be manufactured.

Next, the ink film 110 is irradiated with the laser light and the internal terminal groups 130 are formed (step S140). More specifically, while moving the movable table 240 (FIG. 20) in the X-direction shown in FIG. 23, a plurality of linear internal terminals 131*d*, 131*e*, 132*d* and 132*e* extending in the longitudinal direction of the fuse film 120 (i.e. the X-direction) are formed. It should be noted that the internal terminals 131*d*, 131*e*, 132*d* and 132*e* are desirably formed at the same time with the fuse film 120 extending in the X-direction. Next, a plurality of linear internal terminals 131*a*-131*c* and 132*a*-132*c* extending in the orthogonal direction (i.e. the Y-direction) orthogonal to the longitudinal direction (i.e. the X-direction) of the fuse film 120 are formed while moving the movable table 240 in the Y-direction.

Figure 23:
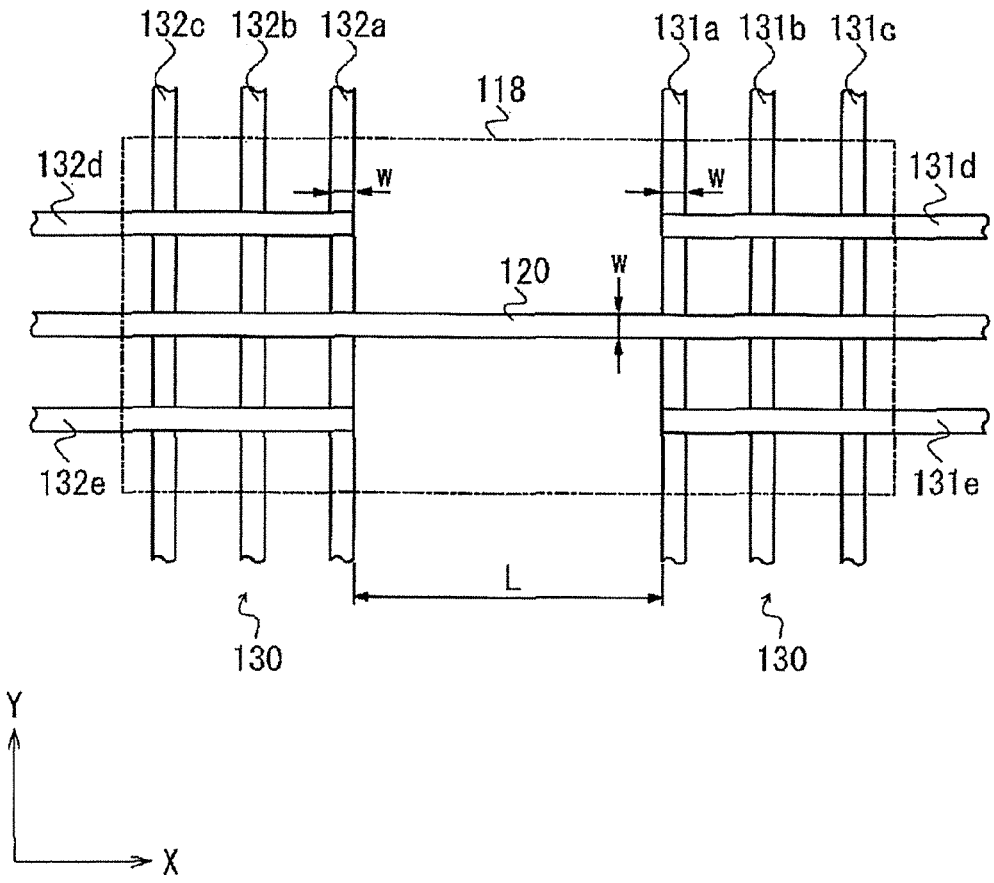
FIG. 23 is a diagram showing the condition in which the internal terminal groups 130 are formed with respect to the fuse film 120.

FIG. 23 is a diagram showing the condition in which the internal terminal groups 130 are formed with respect to the fuse film 120. It should be noted that, in FIG. 23, the fuse film 120 and the internal terminal groups 130 configuring one sub-assembly 118 are shown to extend in a linear manner to connect to the fuse film and the internal terminal groups of other sub-assemblies 118. The portions of the fuse film 120 and the internal terminal groups 130 which run off from the region of the sub-assembly 118 are cut off when the sub-assembly 118 is cut out from the aggregated substrate 100. It should also be noted that, unlike FIG. 23, the fuse film 120 and the internal terminal groups 130 may be formed such that they do not run off from the sub-assembly 118.

As can be seen from FIG. 23, the internal terminal group 130 including a plurality of internal terminals, which are separated from each other in the longitudinal direction, is formed on each of both end sides in the longitudinal direction of the sub-assembly 180 of the fuse film 120. Each of the two internal terminal groups 130 respectively include three internal terminals 131*a*-131*c* and three internal terminals 132*a*-132*c* having the same shape. Additionally, each of the internal terminal groups 130 respectively include internal terminals 131*d* and 131*e* which connect the separated-apart internal terminals 131*a*-131*c* and the internal terminals 132*d* and 132*e* which connect the separated-apart internal terminals 132*a*-132*c*.

Each of the plurality of internal terminals of the internal terminal group 130 of the present embodiment is formed under the same irradiation conditions as those at the time of forming the fuse film 120. Accordingly, the width w of the internal terminals (the description will be given by taking the internal terminal 131*a* as an example) of the internal terminal group 130 is the same as the width of the fuse film 120. The thickness of the internal terminal 131*a* is also the same as the thickness of the fuse film 120. Thus, according to the present embodiment, an internal terminal 131*a* having a small cross-sectional shape similarly to that of the fuse film 120 may be formed.

Moreover, according to the present embodiment, since the fuse film 120 and the internal terminal groups 130 are formed during the firing process, the internal terminal groups 130 may be formed with a higher precision with respect to the fuse film as compared to the case where the fuse film and the internal terminals are formed in separate processes. In addition, it is readily possible to make the cross-sectional shapes of the fuse film 120 and the internal terminal group 130 the same.

(Cleaning Process S108)

Referring back to FIG. 18, in the cleaning process, the ink that has not been irradiated with the laser light in the firing process is washed away and dried. It should be noted that, as the cleaning method, ultrasonic cleaning by means of, for example, an isopropyl alcohol solution, is used.

After the cleaning, the electric resistance R between the internal terminal 131*a* and the internal terminal 132*a* may be measured. Using the measured electric resistance R, the resistivity ρ may be determined from the following expression (13). In the present example, the resistivity ρ is 4.5 (μΩcm). It should be noted that the electric resistance R was measured using the publicly-known four-terminal method.

$$\rho = R \cdot t \cdot w / L \tag{13}$$

(Post-Process S110)

In the post-process, the formation of an overcoat and external terminals is mainly carried out. The specific flow of the post-process will be described hereinafter, with reference to FIG. 24.

Figure 24:
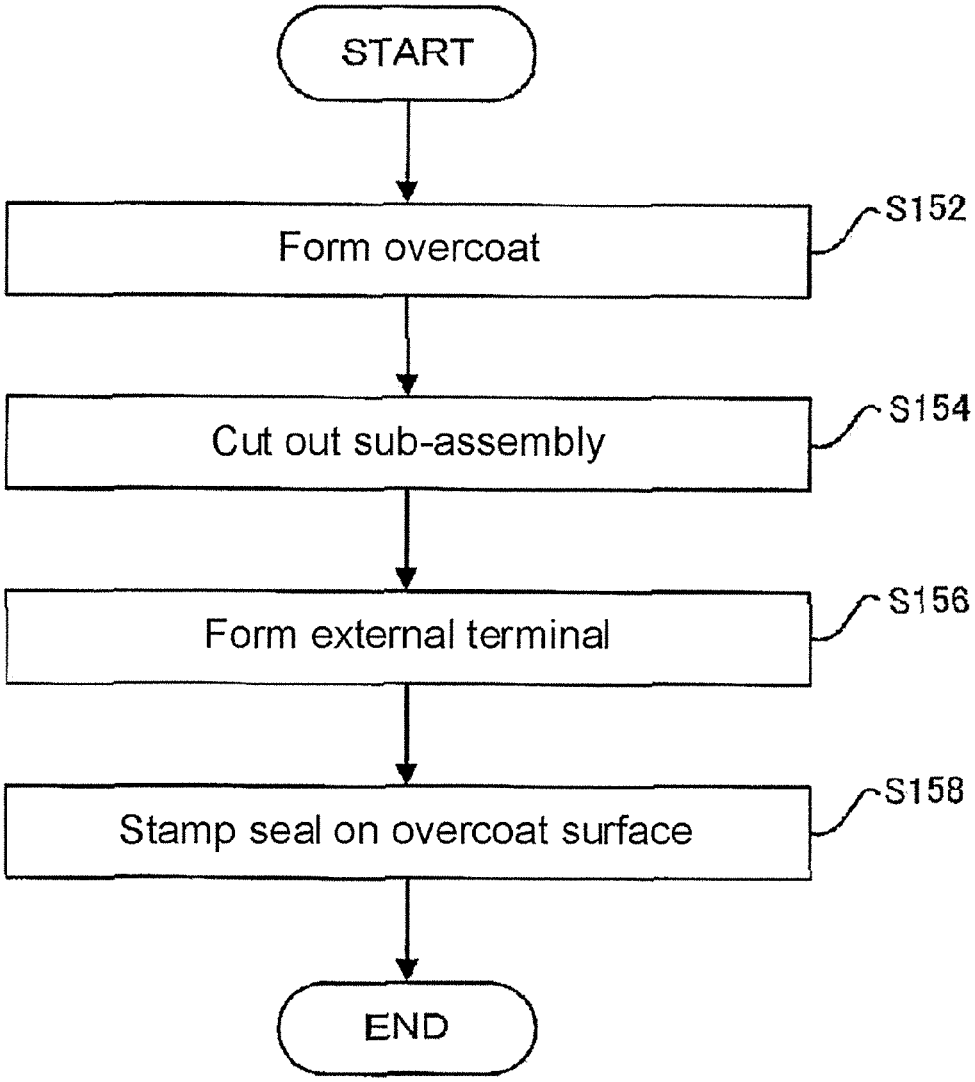
FIG. 24 is a flowchart showing the details of the post-process.

FIG. 24 is a flowchart showing the details of the post-process. First, the overcoat 140 is formed on the sub-assembly 118 (step S152). The overcoat 140 is formed after identifying the positions of the respective sub-assemblies 180 on the aggregated substrate 100 based on the above-described point of origin (i.e. the position of the alignment mark 115*a*). More specifically, as shown in FIG. 25, the overcoat 140 is formed to cover the central portion in the longitudinal direction of the fuse film 120.

Figure 25:
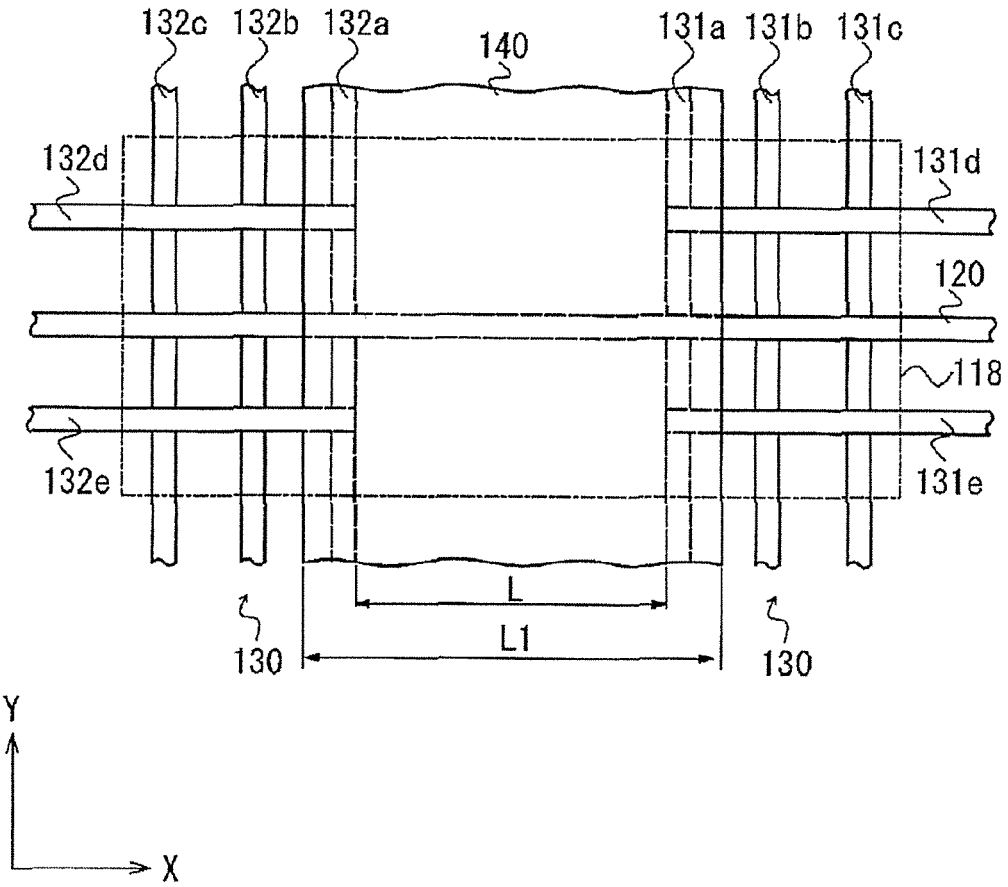
FIG. 25 is a diagram showing the condition in which an overcoat 140 is formed on a sub-assembly 118.

FIG. 25 is a diagram showing the condition in which the overcoat 140 is formed on the sub-assembly 118. The overcoat 140 is formed to cover, in addition to the fuse film 120, the internal terminals 131*a* and 132*a*, which are located closest to the central portion, among the internal terminal groups 130. Namely, the overcoat 140 covers the range L1 that spreads over the internal terminals 131*a* and 132*a* defining the length L of the fuse film 120.

The overcoat 140 is mainly made of silicone resin and has a thermal conductivity of approximately 0.2 (W/mK) at room temperature. The overcoat 140 is formed using, for example, screen printing. More specifically, the overcoat 140 is formed by hardening the resin after the printing at a predetermined temperature. The thickness of the overcoat 140 after the formation is approximately 40 (μm).

Next, the sub-assembly 118 formed with the overcoat 140 is cut out from the aggregated substrate 100 (step S154).

Figure 26:
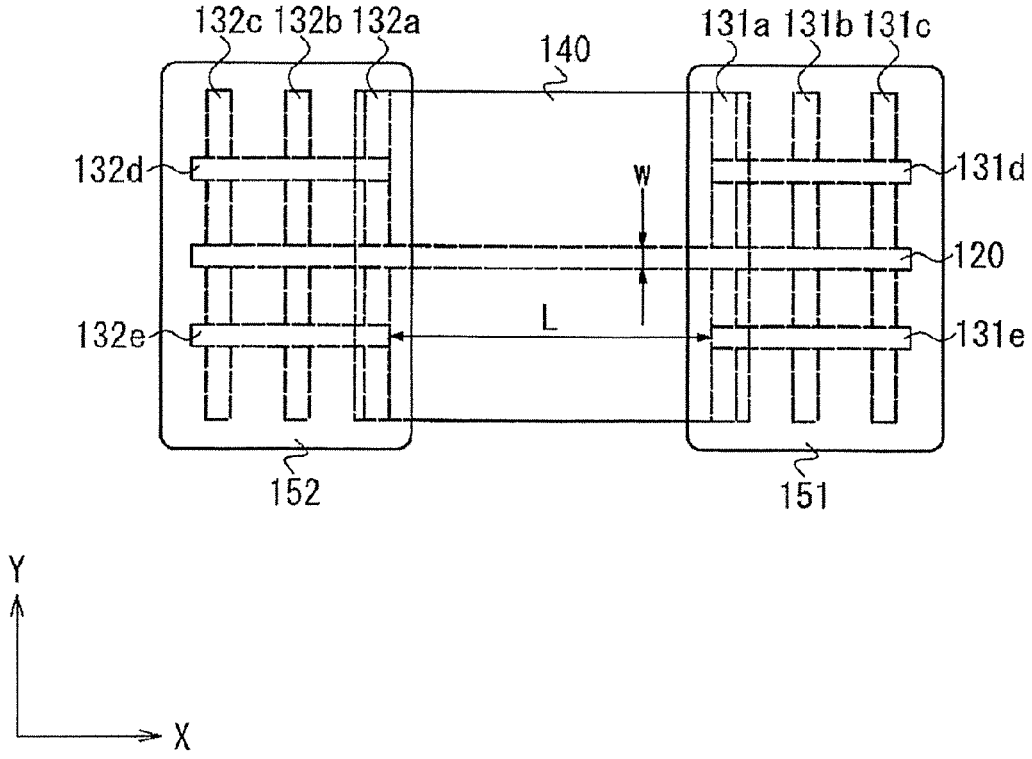
FIG. 26 is a diagram showing the condition after external terminals 151, 152 are formed.

Next, the external terminals 151, 152 which connect to the internal terminals are formed on both end parts in the longitudinal direction of the sub-assembly 118 (step S156). More specifically, as shown in FIG. 26, the external terminals 151, 152 are formed to connect to the internal terminals, which are not covered with the overcoat 140, of the internal terminal groups 130. The external terminals 151, 152 are, for example, mainly made of silver.

FIG. 26 is a diagram showing the condition after the external terminals 151, 152 are formed. As shown in FIG. 26, the external terminal 151 is formed to connect to the internal terminals 131*b* and 131*c*, which are located on one end side in the longitudinal direction, among the internal terminals 131*a*-131*c*. Similarly, the external terminal 152 is formed to connect to the internal terminals 132*b* and 132*c*, which are located on the other end side in the longitudinal direction, among the internal terminals 132*a*-132*c*. It should be noted that the external terminal 151 covers the entirety of the internal terminals 131*b* and 131*c* and the external terminal 152 covers the entirety of the internal terminals 132*b* and 132*c*. Then, the external terminal 151 and the external terminal 152 are formed so that parts of them are located over the overcoat 140.

Figure 27:
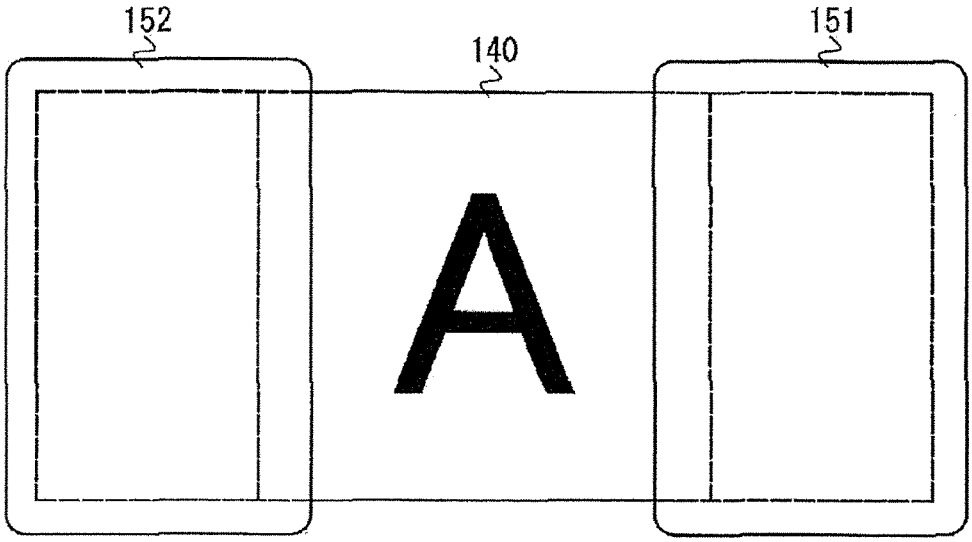
FIG. 27 is a diagram for explaining the stamping of a seal onto the overcoat 140.

With the formation of the external terminals 151, 152, the chip fuse 1 in the product form is obtained. Next, a seal is stamped onto the surface of the overcoat 140 (step S158). It should be noted that Ni plating or Sn plating may be applied to the external terminals 151, 152 after the seal is stamped onto the overcoat 140. FIG. 27 is a diagram for explaining the stamping of a seal onto the overcoat 140. For example, as shown in FIG. 27, a character may be stamped onto the surface of the overcoat 140. However, the present invention is not limited thereto, and instead of a character or, alternatively, along with a character, a symbol or number may be stamped.

(Inspection Process S112)

Referring back to FIG. 18, in the inspection process, the resistance, etc. of the chip fuse 1 are inspected. The chip fuse 1 is packed and shipped after the inspection. Thereby, the set of manufacturing processes of the chip fuse 1 is completed.

According to the above-described method for manufacturing the chip fuse, the ink film 110 containing the metal nanoparticles is fired and then the fuse film 120 is formed. In such case, a thin film chip fuse can be achieved secured with a minimum melting current of 100 mA or less and with a predetermined rush resistance in the pre-arcing time-current characteristic, without using a patterning surface preparation of the fuse film, a patterning mask, or the like, and without adding to the fuse film a low melting-point metal, such as tin. Moreover, since the fuse film 120 is formed by irradiating and scanning the ink film 110 with the laser light, the fuse film 120 can be manufactured at a cheap cost and high volume.

In addition, since, the internal terminal groups 130 are connected and formed to be orthogonal to the fuse films 120 after consecutively forming a plurality of such fuse films 120, the reliability regarding conduction of the fuse films 120 can be improved. Further, the production efficiency was improved by implementing the formation of the fuse film 120 and the internal terminal groups 130 in the same firing process.

It should be noted that, in the above-described embodiment, step S102 corresponds to the liquid film forming step, step S134 corresponds to the mark forming step, step S138 corresponds to the fuse film forming step, step S140 corresponds to the first terminal forming step, step S152 corresponds to the covering part forming step, and step S156 corresponds to the second terminal forming step.

<5. Study Regarding the Firing of Ink Film>

The inventors conducted various studies regarding the firing process for forming the fuse film 120 by firing the ink film and came to realize the above-described manufacturing method based on the study results. The content of the study will be described hereinafter.

According to the above-described method for manufacturing the chip fuse, the fuse film 120 of the chip fuse 1 was formed by firing the ink film 110. Meanwhile, the thickness t of the fuse film 120 of the chip fuse 1 that achieves melting at 100 (mA) or less is 0.1 (μm)-2.45 (μm). However, in terms of securing productivity while suppressing the increase in the specific surface area as much as possible, it is necessary to achieve the thickness t of 0.1 (μm)-3.0 (μm). Therefore, the inventors found an approach to control the fuse film thickness after the firing by controlling the thickness of the ink film 110.

Figure 28:
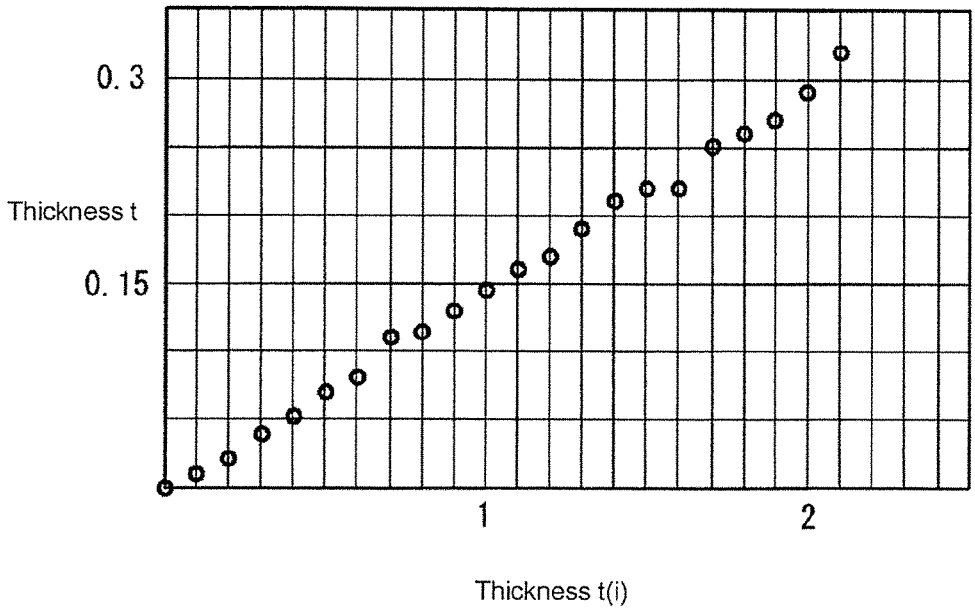
FIG. 28 is a graph showing the relationship between the thickness t(i) of the ink film prior to the firing and the thickness t of the fuse film after the firing.

FIG. 28 is a graph showing the relationship between the thickness t(i) of the ink film 110 prior to the firing and the thickness t of the fuse film 120 after the firing. The ink film 110 here is an ink film containing silver nanoparticles and is formed on a polyimide substrate. As can be seen from the graph, there is a proportional relationship between the thickness t(i) of the ink film 110 and the thickness t of the fuse film 120, and thus, the thickness t after the firing can be controlled by controlling the thickness t(i) prior to the firing.

It should be noted that a similar result was obtained in an experiment using an ink jet instead of a spin coater. Moreover, it was confirmed that the thickness t of the fuse film 120 after the firing can be controlled by controlling the thickness t(i) of the ink film 110 even with other printing methods such as flexo printing, gravure printing, or the like. It should be noted that the firing is not limited to firing by means of irradiation of the laser light and that the same was confirmed with firing by means of a blast furnace.

Additionally, the inventors conducted a study on a method for controlling the width w of the fuse film 120. The inventors considered that if irradiation of light laser having an appropriate wavelength and an intensity were performed, the firing of ink containing metal nanoparticles could be achieved since it exhibits Plasmon absorption characteristics over a wide range of wavelength band (for example, the wavelength of the irradiation light is 300 nm-1200 nm). Moreover, the inventors focused on the facts that the irradiation intensity of the laser light increases when the spot diameter φ (L) is reduced and that the spot diameter of the laser light can be reduced to a minute diameter typified by a wavelength. Then, the inventors considered that it may be possible to achieve a width of the fuse film 120 which corresponds to a spot diameter of the laser light by irradiating and scanning the ink with the laser light having such minute spot diameter, thus, made efforts for realizing it.

First, an experiment for confirming the relationship between the spot diameter φ and the width w of the fuse film 120 was carried out. In the experiment, ink containing metal nanoparticles with an average particle size of approximately 3-30 (nm) was printed and dried on the support substrate. Thereafter, irradiation onto the ink film was performed either by Nd-YAG laser light with a wavelength of 1,064 (nm) at an average irradiation intensity of $3.0\times10^4$-$5.0\times10^5$ (W/cm$^2$) or by Nd-YAG laser harmonic with a wavelength of 532 (nm) at an average irradiation intensity of $2.0\times10^3$-$7.0\times10^4$ (W/cm$^2$), and both at a scanning velocity of 3-90 (mm/s). The experimental results are shown in FIG. 29.

Figure 29:
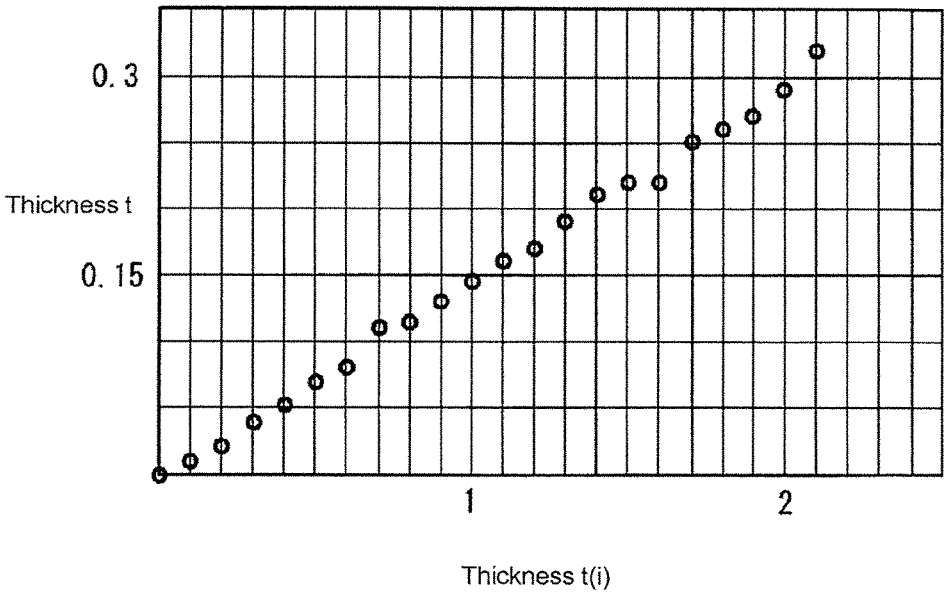
FIG. 29 is a graph showing the relationship between the spot diameter φ of the laser light and the width w of the fuse film 120.

FIG. 29 is a graph showing the relationship between the spot diameter φ of the laser light and the width w of the fuse film 120. As shown in the graph, the width w of the fuse film 120 after the firing has a proportional relationship with the spot diameter φ. It should be noted that the spot diameter φ was measured by a beam profiler or determined, for example, by actually irradiating the substrate with the laser light and measuring the processed trace geometry.

Here, the numerical ranges of the factors in the above-described experiment will be described. The upper limit of the particle size of the metal nanoparticles is set as 30 (nm) in terms of securing dispersal stability and the lower limit value of 3 (nm) is determined from the average particle size range of the metal nanoparticles that are actually and stably available. When the average irradiation intensity of Nd-YAG laser light having a wavelength of 1,064 (nm) is smaller than $3.0\times10^4$ (W/cm$^2$), the ink cannot be sufficiently fired and thus, the adhesion to the support substrate will be insufficient. In contrast, when the average irradiation intensity is larger than $5.0\times10^5$ (W/cm$^2$), the metal particles may scatter or evaporate (hereinafter, also referred to as "metal particle ablation") or the support substrate may thermally deform (hereinafter, also referred to as "substrate ablation") in the course of firing, and thus, there is a risk that the fuse film 120 may not be properly formed. For this reason, the average irradiation intensity of the Nd-YAG laser light having a wavelength of 1,064 (nm) was set to $3.0\times10^4$-$5.0\times10^5$ (W/cm$^2$).

The Nd-YAG harmonic with a wavelength of 532 (nm) has a higher Plasmon absorption efficiency of the nanometals than the Nd-YAG laser light with a wavelength of 1,064 (nm), and thus, it is necessary to reduce the average irradiation intensity accordingly. Thus, the average irradiation intensity was set to $2.0\times10^3$-$7.0\times10^4$ (W/cm$^2$). Incidentally, the scanning velocity of the laser light also plays a significant part in the appropriate firing of the ink, in addition to the average irradiation intensity of the laser light. For example, when the scanning velocity of the laser light exceeds 90 (mm/s), the ink cannot be fired appropriately. This could not be solved even by increasing the irradiation intensity. Accordingly, it is desirable for the scanning velocity of the laser light to also be set within an appropriate range. In particular, it is important to combine the scanning velocity and the irradiation intensity, both within the appropriate ranges, in view of the ink film thickness, the laser light spot diameter, or the like.

The inventors applied knowledge of thermal dynamics and the like to the present embodiment. In a system where the surface of the ink film 110 is irradiated with laser light having a predetermined irradiation intensity, and thus, the heating and the firing are performed from the surface, the average distance L (L) over which the heat reaches in the thickness direction of the ink film 110 is as defined in the following expression (14):

$$L(L)=K_1\cdot(\kappa_i)^{\alpha}\cdot\tau^{\beta} \tag{14}$$

It should be noted that $\kappa_i$ is the average thermal diffusivity in the thickness direction of the ink film 110, τ is a representative irradiation time of laser light, α, β are predetermined numbers under conditions of α>0 and β>0, and K1 is a proportional constant.

When the spot diameter of the irradiating laser light is denoted by φ (L) and the relative scanning velocity of the laser light is denoted by V (L), the representative irradiation time τ of the laser light according to the present embodiment when the ink film 110 is irradiated with the laser light in a continuous oscillation mode is as defined in the following expression (15):

$$\tau=K_2\cdot\varphi(L)/V(L) \tag{15}$$

It should be noted that $K_2$ is a correction coefficient relating to the laser irradiation beam geometry, or the like.

When expression (15) is substituted into expression (14), expression (16) is obtained:

$$L(L)=K_1\cdot(\kappa_i)^{\alpha}\cdot(K_2\cdot\varphi(L)/V(L))^{\beta} \tag{16}$$

According to expression (16), the distance L (L) over which the heat reaches is determined by each of the factors $\kappa_i$, φ (L) and V (L), and this means that there are combinations for the values of each of the factors. Namely, when the thermal diffusivity $\kappa_i$ and the spot diameter φ (L) are fixed, the distance L (L) is considered to be determined by the scanning velocity V (L). In the present embodiment, when it is considered that the distance L (L) represents the thickness of firing of the ink film 110, it can be considered that the scanning velocity V (L) needs to be selected in line with the spot diameter φ (L), when the thickness of the ink film 110 and the average thermal diffusivity $\kappa_i$ are fixed. Further, as a result of confirming the thickness t (L) of the firing of the ink film 110 when the spot diameter φ (L) and the scanning velocity V (L) are varied, it became clear that the distance L (L) has a strong correlation with the thickness t (L). Namely, it is considered that the average distance L (L) over which the heat reaches in the thickness direction of the nanometals represents the thickness t (L).

It should be noted that, when the thickness t of the fuse film 120 is larger than approximately 3.0 (μm), the firing needs to be performed by extremely decreasing the scanning velocity, and thus, it was determined that this is not practical in the present embodiment. On the other hand, when the thickness t was smaller than approximately 0.1 (μm), the firing of the ink film 110 became unstable even if the scanning velocity was increased, and substrate ablation occurred and the fuse film 120 could not be formed.

In the present embodiment, the firing is performed not only at the surface of the ink film 110 but also fully up to the bonded interface between the ink film 110 and the support substrate so as to avoid inconveniences such as metal particle ablation, substrate ablation, or the like. In addition, when a layered clay substrate, which has a higher heat resistance as compared to a polyimide substrate, is used as the support substrate, substrate ablation is unlikely to occur and thus, there is a certain effect that the firing conditions, such as the irradiation intensity of the laser light, or the like, can be relaxed.

<6. Variation>

It should be noted that, in the description above, a spin coater is used to print the ink containing the metal nanoparticles onto the entire surface 102 of the aggregated substrate 100 (see FIG. 19); however, the present invention is not limited thereto, and for example, an ink jet printer, or the like, may be utilized to print the ink onto the portions where the fuse film 120 is to be formed.

Further, in the description above, the internal terminal groups 130 are described as being formed by irradiating the ink film 110 with the laser light; however, the present invention is not limited thereto. For example, the internal terminal groups 130 may be formed by utilizing other methods, such as screen printing, or the like.

Moreover, in the description above, each of the external terminals 51, 52 is described as making contact with and as being electrically connected to the internal terminals of the internal terminal groups 31, 32; however, the present invention is not limited thereto. For example, a plate-like intermediate member may be provided between the external terminals 51, 52 and the internal terminal groups 31, 32, and the external terminals 51, 52 may be electrically connected to the internal terminal groups 31, 32 via the intermediate member. In such case, a stable connected condition between the internal terminal groups 31, 32 and the external terminals 51, 52 can be secured since the contact area in which the external terminals 51, 52 make contact can be enlarged by sandwiching the plate-like intermediate member therebetween.

Additionally, in the description above, the support substrate 10 is described as being a polyimide substrate; however, the present invention is not limited thereto. As long as the support substrate 10 is a substrate that has the same properties, such as physical properties, surface roughness, or the like, as the support substrate, it may be, for example, a layered clay substrate containing montmorillonite as a principal component. Moreover, the support substrate 10 may be obtained by joining a layered clay substrate containing montmorillonite as a principal component and a polyimide substrate, and the fuse film may be formed on a surface of either the layered clay substrate or the polyimide substrate, as necessary.

In addition, in the description above, the overcoat is described as being mainly made of silicone resin; however, the present invention is not limited thereto. For example, the overcoat may be made of heat-resistant resin, such as epoxy resin, or the like.

Further, in the description above, the fuse film is described as being configured by a single straight line; however, the present invention is not limited thereto. For example, the fuse film may be configured by a plurality of straight lines or configured in a grid form. In particular, when a fuse film is formed by the irradiation of laser light, as described above, a fuse film in various shapes can be easily formed on the support substrate without using a patterning surface preparation or a patterning mask.

Moreover, in the description above, the metal nanoparticles contained in the ink film are described as being silver nanoparticles; however, the present invention is not limited thereto. For example, the metal nanoparticles may be copper nanoparticles or gold nanoparticles.

As described above, the present invention is explained with the exemplary embodiments; however, the technical scope of the present invention is not limited to the scope described in the above embodiments. It is apparent for those skilled in the art that it is possible to make various changes and modifications to the embodiments above. It is apparent from the description of the claims that the forms added with such changes and modifications may be included within the technical scope of the present invention.

What is claimed is:

1. A chip fuse comprising:

a substrate;

a fuse film, being provided on a principal surface of the substrate;

an one-end-side internal terminal group, being provided at one end side of the fuse film on the principal surface and including a plurality of first internal terminals that are connected to the fuse film while separated from each other in a longitudinal direction; and an other-end-side internal terminal group, being provided at the other end side of the fuse film on the principal surface and including a plurality of second internal terminals that are connected to the fuse film while separated from each other in the longitudinal direction.

2. The chip fuse according to claim 1, further comprising:

a covering part that covers a central portion in the longitudinal direction of the fuse film;

a one-end-side external terminal that electrically connects to one or more of the plurality of first internal terminals of the one-end-side internal terminal group; and an other-end-side external terminal that electrically connects to one or more of the plurality of the second internal terminals of the other-end-side internal terminal group.

3. The chip fuse according to claim 1, wherein each first internal terminal of the one-end-side internal terminal group and each second internal terminal of the other-end-side internal terminal group are provided along an intersecting direction that intersects with the longitudinal direction of the fuse film, and the width of the each first internal terminal of the one-end-side internal terminal group and the width of the each second internal terminal of the other-end-side internal terminal group are the same as the width of the fuse film.

4. The chip fuse according to claim 1, wherein the thickness of each first internal terminal of the one-end-side internal terminal group and the thickness of each second internal terminal of the other-end-side internal terminal group are the same as the thickness of the fuse film.

5. The chip fuse according to claim 2, wherein the covering part also covers the first internal terminal that is located closest to the central portion in the longitudinal direction among the one-end-side internal terminal group and the second internal terminal that is located closest to the central portion in the longitudinal direction among the other-end-side internal terminal group.

6. The chip fuse according to claim 1, wherein a melting current density, which is obtained by dividing a melting current that melts the fuse film by a cross-sectional area that is orthogonal to the longitudinal direction of the fuse film, is $4.0\times10^6$ (A/cm$^2$) or less.

7. The chip fuse according to claim 6, wherein a specific surface area, which is obtained by dividing a surface area of the fuse film by a volume of the fuse film, is 21 (/μm) or less.

8. The chip fuse according to claim 7, wherein when assuming the width of the fuse film to be width w and the thickness of the fuse film to be film thickness t, the width w is between 3 (μm) and 20 (μm), inclusive; and the film thickness t is between 0.1 (μm) and 3.0 (μm), inclusive.

9. The chip fuse according to claim 2, wherein thermal conductivities of both the substrate and the covering part are 0.3 (W/m·K) or less.

10. The chip fuse according to claim 6, wherein the length of the fuse film between the first internal terminal that is located closest to a central portion in the longitudinal direction among the first internal terminals of the one-end-side internal terminal groups and the second internal terminal that is located closest to a central portion in the longitudinal direction among the second internal terminals of the other-end-side internal terminal groups is 600 (μm) or more.

* * * * *